US009130274B1

(12) United States Patent
Vincent

(10) Patent No.: US 9,130,274 B1
(45) **Date of Patent: *Sep. 8, 2015**

(54) SYSTEMS AND METHODS FOR PROVIDING DISTRIBUTED LOAD MONOPOLE ANTENNA SYSTEMS

(75) Inventor: Robert J. Vincent, Warwick, RI (US)

(73) Assignee: BOARD OF EDUCATION, STATE OF RHODE ISLAND AND PROVIDENCE PLANTATIONS, Providence, RI (US)

( * ) Notice: Subject to any disclaimer, the term of this patent is extended or adjusted under 35 U.S.C. 154(b) by 414 days.

This patent is subject to a terminal disclaimer.

(21) Appl. No.: 12/860,975

(22) Filed: Aug. 23, 2010

Related U.S. Application Data

(63) Continuation-in-part of application No. 11/689,679, filed on Mar. 22, 2007, now Pat. No. 7,782,264.

(51) Int. Cl.
*H01Q 9/32* (2006.01)

(52) U.S. Cl.
CPC ..... *H01Q 9/32* (2013.01)

(58) Field of Classification Search
CPC ..... H01Q 9/32
USPC ..... 343/722, 745, 749, 750, 752, 860, 876
See application file for complete search history.

(56) References Cited

U.S. PATENT DOCUMENTS

| | | | | |
|---|---|---|---|---|
| 2,311,472 | A | | 2/1943 | Roosenstein |
| 3,445,849 | A | | 5/1969 | Sanford |
| 3,521,169 | A | | 7/1970 | Turner et al. |
| 3,618,104 | A | * | 11/1971 | Behr ..... 343/745 |
| 3,689,928 | A | | 9/1972 | Felsenheld |
| 3,909,830 | A | | 9/1975 | Campbell |
| 3,967,276 | A | | 6/1976 | Goubau |
| 3,984,839 | A | | 10/1976 | Ray, Jr. |
| 4,095,229 | A | | 6/1978 | Elliott |
| 4,201,960 | A | * | 5/1980 | Skutta et al. ..... 333/17.3 |
| 4,229,743 | A | | 10/1980 | Vo et al. |
| 4,343,001 | A | * | 8/1982 | Anderson et al. ..... 343/745 |
| 4,442,436 | A | | 4/1984 | Newcomb |
| 4,564,843 | A | | 1/1986 | Cooper |
| 4,656,483 | A | | 4/1987 | Jaquet |
| 4,734,703 | A | | 3/1988 | Nakase et al. |

(Continued)

OTHER PUBLICATIONS

Harrison, Jr., "Monopole with Inductive Loading," IEEE Transactions on Antennas and Propagation, Sandia Corporation, Albuquerque, NM, Dec. 26, 1962, pp. 394-400.

(Continued)

*Primary Examiner* — Michael C Wimer
(74) *Attorney, Agent, or Firm* — Gesmer Updegrove, LLP

(57) ABSTRACT

A distributed load monopole antenna system is disclosed that includes a monopole antenna comprising a radiation resistance unit coupled to a transmitter base, an adjustment unit, a current enhancing unit and a conductive mid-section. The radiation resistance unit includes a radiation resistance unit base that is coupled to ground, and includes a plurality of windings of an electrically conductive material. The adjustment unit is coupled to at least one of the plurality of windings of the radiation resistance unit, and is coupled to ground for selectively adjusting an operating frequency of the antenna. The current enhancing unit is for enhancing current through the radiation resistance unit, and the conductive mid-section is intermediate the radiation resistance unit and the current enhancing unit.

19 Claims, 26 Drawing Sheets

(56) References Cited

U.S. PATENT DOCUMENTS

| | | | | |
|---|---|---|---|---|
| 5,016,021 | A | 5/1991 | Newcomb | |
| 5,065,164 | A | 11/1991 | Deasy | |
| 5,134,419 | A | 7/1992 | Egashira | |
| 5,406,296 | A | 4/1995 | Egashira et al. | |
| 5,521,607 | A | 5/1996 | Deasy | |
| 5,856,808 | A | 1/1999 | Holshouser et al. | |
| 5,955,996 | A | 9/1999 | Clubb | |
| 6,054,958 | A | 4/2000 | Holshouser et al. | |
| 6,208,306 | B1 | 3/2001 | McLean et al. | |
| 6,437,756 | B1 | 8/2002 | Schantz | |
| 6,791,504 | B1 | 9/2004 | Miller et al. | |
| 7,099,643 | B2 | 8/2006 | Lin | |
| 7,187,335 | B2 | 3/2007 | Vincent | |
| 7,358,911 | B2 | 4/2008 | Vincent | |
| 7,782,264 | B1 * | 8/2010 | Vincent | 343/745 |

OTHER PUBLICATIONS

Fujimoto et al., "Small Antennas," Research Studies Press Ltd., Letchworth, Hertfordshire, England & John Wiley & Sons Inc., New York, 1987, pp. 59-75.

"Now You're Talking!: All You Need to Get Your First Ham Radio License," The American Radio Relay League, Inc., Second Edition, Apr. 1996, Chapter 7, pp. 16-17.

"The Offset Multiband Trapless Antenna (OMTA)," QST, vol. 79, No. 10, American Radio Relay League, Inc., 1996, pp. 1-11.

"Mounting Tips for the Stealth II Series HF Mobile Antennas," Version 3.32, Aug. 2002, pp. 1-9.

Nakano et al., "A Monofilar Spiral Antenna Excited Through a Helical Wire," IEEE Transactions of Antennas and Propagation, vol. 51, No. 3, Mar. 2003, pp. 661-664.

"Helix Antenna," http://library.kmitnb.ac.th/projects/eng/EE/ee0003e.html.

T. Simpson, "The Disk Loaded Monopole Antenna," IEEE Transactions of Antennas and Propagation, vol. 52, No. 2, Feb. 2004, pp. 542-545.

Hale, Bruce S. (Editor), "The ARRL Handbook for the Radio Amateur". pp. 33-15 through pp. 33-17. American Radio Relay League, 1989 Newington, US.

Rothammel, Karl, "Antennenbuch (8. Auflage)". p. 514, paragraph 28.1 through p. 525, paragraph 28.3. Telekosmos-Verlag Franckh'Sche Verlagshandlung, 1984, Stuttgart, DE.

W5BIG: Antenna Analyzer AIM430, Bob Clunn, 2005, sheet 1-6 to 6-6.

* cited by examiner

50

| | Frequency MHz | SWR | R | X |
|---|---|---|---|---|
| 0 | 6.7000 | 6.2000 | 123.00 | 188.00 |
| 1 | 6.8000 | 4.3000 | 94.000 | 110.00 |
| 2 | 6.9000 | 2.6000 | 69.000 | 58.000 |
| 3 | 6.9250 | 2.3000 | 65.000 | 47.000 |
| 4 | 6.9500 | 2.1000 | 62.000 | 37.000 |
| 5 | 6.9750 | 1.8000 | 56.000 | 29.000 |
| 6 | 7.0000 | 1.4000 | 52.000 | 19.000 |
| 7 | 7.0250 | 1.3000 | 51.000 | 14.000 |
| 8 | 7.0500 | 1.0000 | 50.000 | 2.0000 |
| 9 | 7.0750 | 1.2000 | 48.000 | 8.0000 |
| 10 | 7.1000 | 1.4000 | 47.000 | 15.000 |
| 11 | 7.1250 | 1.6000 | 45.000 | 23.000 |
| 12 | 7.1500 | 1.8000 | 42.000 | 32.000 |
| 13 | 7.1750 | 2.2000 | 37.000 | 41.000 |
| 14 | 7.2000 | 2.5000 | 32.000 | 50.000 |
| 15 | 7.3000 | 4.5000 | 20.000 | 75.000 |
| 16 | 7.4000 | 6.9000 | 14.000 | 96.000 |
| 17 | 7.5000 | 9.8000 | 9.0000 | 114.00 |

FIG. 4

Measured field level variations 3.5 turn Tapped helix.
Levels in comparison to a normal Plano Spiral helix DLM operating at 7 MHz Figure 3 gain vs freq. Plano Spiral helix 3.5 turn

SYSTEMS AND METHODS FOR PROVIDING DISTRIBUTED LOAD MONOPOLE ANTENNA SYSTEMS

PRIORITY

The present application is a continuation-in-part application of U.S. Ser. No. 11/689,679 filed Mar. 22, 2007, which claims priority to U.S. Provisional Patent Application Ser. No. 60/786,437 filed Mar. 28, 2006.

BACKGROUND

The present invention generally relates to antennas, and relates in particular to antenna systems that include one or more monopole antennas.

Monopole antennas typically include a single pole that may include additional elements with the pole, including for example, additional monopole antennas. Non-monopole antennas generally include antenna structures that form two or three dimensional shapes such as diamonds, squares, circles etc.

As wireless communication systems (such as wireless telephones and wireless networks) become more ubiquitous, the need for smaller and more efficient antennas such as monopole antennas (both large and small) increases. Many monopole antennas operate at very low efficiency yet provide satisfactory results. In order to meet the demand for smaller and more efficient antennas, the efficiency of such antennas must improve.

Further, the adjustment or tuning of the operating frequency of an antenna is sometimes required. Such tuning, however, is typically available only over a small range. Adjustment of an antenna over a wide operating frequency range of for example, up to 2:1 or more generally requires a number of antennas or requires base-loading (sometimes called base-tuning). Base-loading involves matching the antenna load presented to the transmitter by varying the antenna load. The efficiency of such systems, however, is generally low and radiation performance of such antennas will vary widely over the full tuning range of the antenna. Efficiency or antenna gain can vary widely from one end of this tuning range to the other.

For example, base-loaded antennas may have efficiency or gain from a high of 60% to a low of less than 10%. The lower gain is usually associated with the lowest frequency. An antenna with an efficiency or gain of 10% will radiate 1 Watt out of every 10 the transmitter loads into the tuner. This generally results in very robust tuner designs when high power is utilized. A 5 KW transmitter at an impedance of 50 Ohms will be capable of supplying 10 amps of average RF current operating in the continuous mode. This may range to peaks as high as 15 amps or more when amplitude modulation is used. If these 10 to 15 amps of RF current are transformed from 50 Ohms to an impedance that is much higher, then the tuner must be designed to withstand extremely either high voltages or high currents. Either way, it becomes a significant problem at higher power levels to control the antenna matching and maintain efficiency.

As mentioned above, a number of antennas may be used instead of the base-loading technique to achieve wide bandwidth operation. Such a multi-antenna system may include an antenna for each desired frequency. Each antenna may be designed to present a constant 50 Ohm load at the operating frequency confined within some bandwidth. Another alternative involves lengthening and shortening a common antenna by inserting and removing sections of tubing as needed or using a telescoping mast antenna. Telescoping mast antennas present problems in achieving the lowest and highest frequency of operation as the necessary steps for adjusting the antenna are time consuming and labor intensive. For example, for a ¼ wave monopole antenna this typically requires that the antenna be taken apart and re-assembled using longer sections There is a need, therefore, for more efficient and cost effective implementation of a monopole antenna, as well as other types of antennas and antenna systems, and there is a further need for an efficient and cost effective method for tuning such antenna systems. For example, there is a need in particular for a method of rapidly changing the antenna resonance to any desired frequency within its range and while maintaining a constant bandwidth to provide a constant 50Ω match to the transmission line connected to the transmitter or final amplifier. The mechanism for accomplishing this must have the capability of handling the large radio frequency current and transforming this into radiation by the antenna. It is desirable, for example, to provide an antenna designed for typical operation within the AM broadcast band of 535-1700 kHz, and to have a 30 kHz bandwidth (+/−15 kHz).

SUMMARY

The invention provides a distributed load monopole antenna system in accordance with an embodiment that includes a monopole antenna comprising a radiation resistance unit coupled to a transmitter base, an adjustment unit, a current enhancing unit and a conductive mid-section. The radiation resistance unit includes a radiation resistance unit base that is coupled to ground, and includes a plurality of windings of an electrically conductive material. The adjustment unit is coupled to at least one of the plurality of windings of the radiation resistance unit, and is coupled to ground for selectively adjusting an operating frequency of the antenna. The current enhancing unit is for enhancing current through the radiation resistance unit, and the conductive mid-section is intermediate the radiation resistance unit and the current enhancing unit. In accordance with various embodiments, the adjustment unit may include a plurality of connection switches and/or a variable capacitor for tuning the antenna.

In accordance with a further embodiment, the invention provides a capacitor circuit having first and second connection leads, wherein said first connection lead is coupled to one of the plurality of windings of the radiation resistance unit, and said second connection lead is coupled to ground, and in further embodiments, the capacitor is a variable capacitor.

In accordance with a further embodiment, the invention involves a method of providing a distributed load monopole antenna system, said method comprising the steps of: coupling a radiation resistance unit to a transmitter base and to ground, wherein the radiation resistance unit includes a plurality of windings of an electrically conductive material; providing a current enhancing unit for enhancing current through the radiation resistance unit; providing a conductive mid-section intermediate the radiation resistance unit and the current enhancing unit; and coupling a first connection lead of a capacitor circuit to one of the plurality of windings of the radiation resistance unit, and coupling a the second connection lead of the capacitor circuit to ground. In accordance with further embodiments, the invention includes the step of varying the capacitance of the capacitor circuit.

BRIEF DESCRIPTION OF THE DRAWINGS

The following description may be further understood with reference to the accompanying drawings in which:

FIG. 4 shows a table of standing wave ratio values (SWR) versus frequency for a system in accordance with an embodiment of the invention;

and

Figure 26:
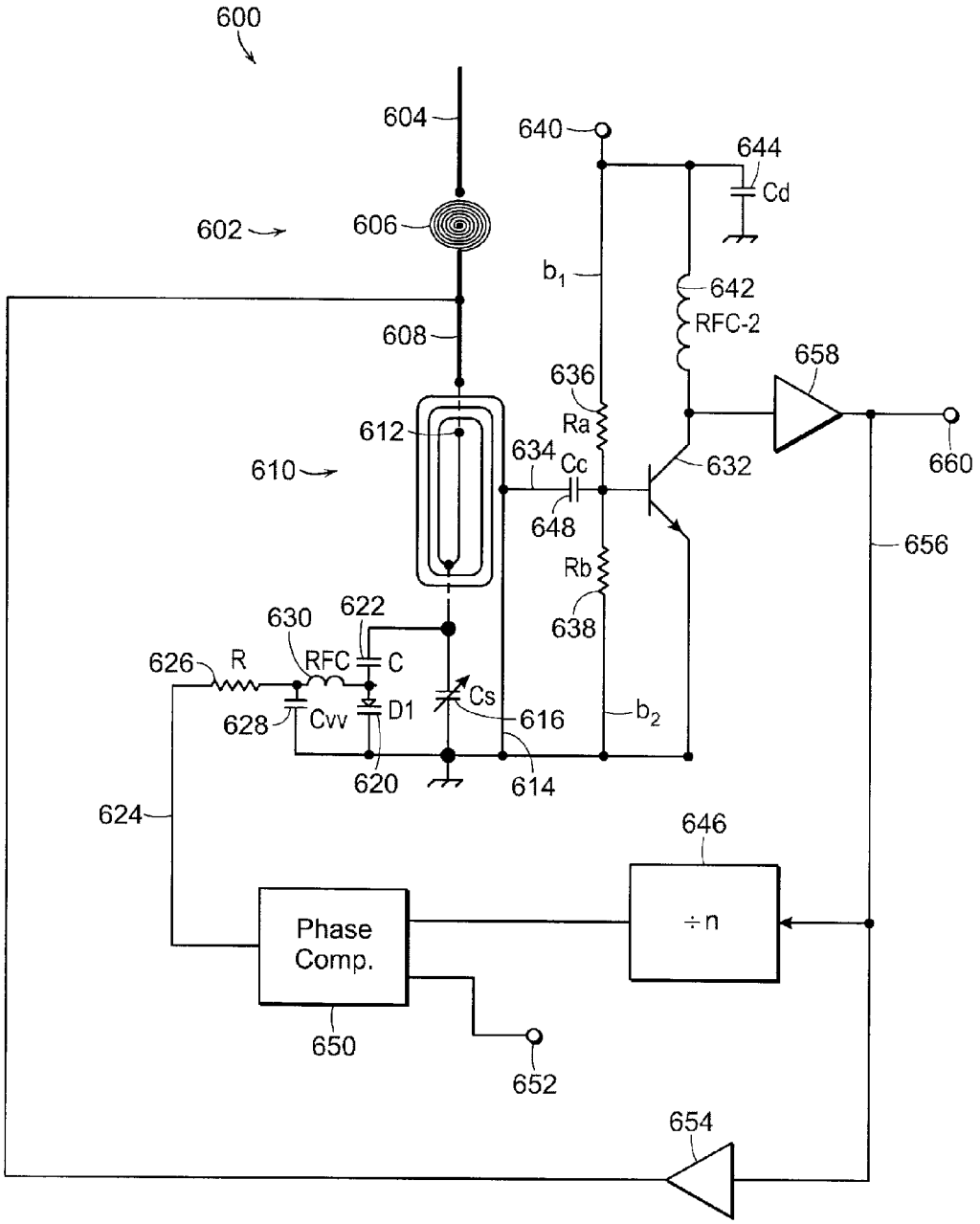

FIG. 26 shows an illustrative diagrammatic view of an antenna system in accordance with a further embodiment of the invention that provides a frequency compensating control voltage in a voltage controlled oscillator or radiator.

The drawings are shown for illustrative purposes only.

DETAILED DESCRIPTION

A distributed load monopole antenna may include a radiation resistance unit for providing significant radiation resistance, and a current enhancing unit for enhancing the current through the radiation enhancing unit as disclosed, for example in U.S. Published Pat. No. 7,187,335, the disclosure of which is hereby incorporated by reference. The radiation resistance unit may include a coil in the shape of a helix, and the current enhancing unit may include load coil and/or a top unit formed as a coil or hub and spoke arrangement. The radiation resistance unit is positioned between the current enhancing unit and a base (e.g., ground), and may, for example, be separated from the current enhancing unit by a distance of $2.5316\times10^{-2}\lambda$, where $\lambda$, is the operating frequency of the antenna, to provide a desired current distribution over the length of the antenna.

Figure 1:
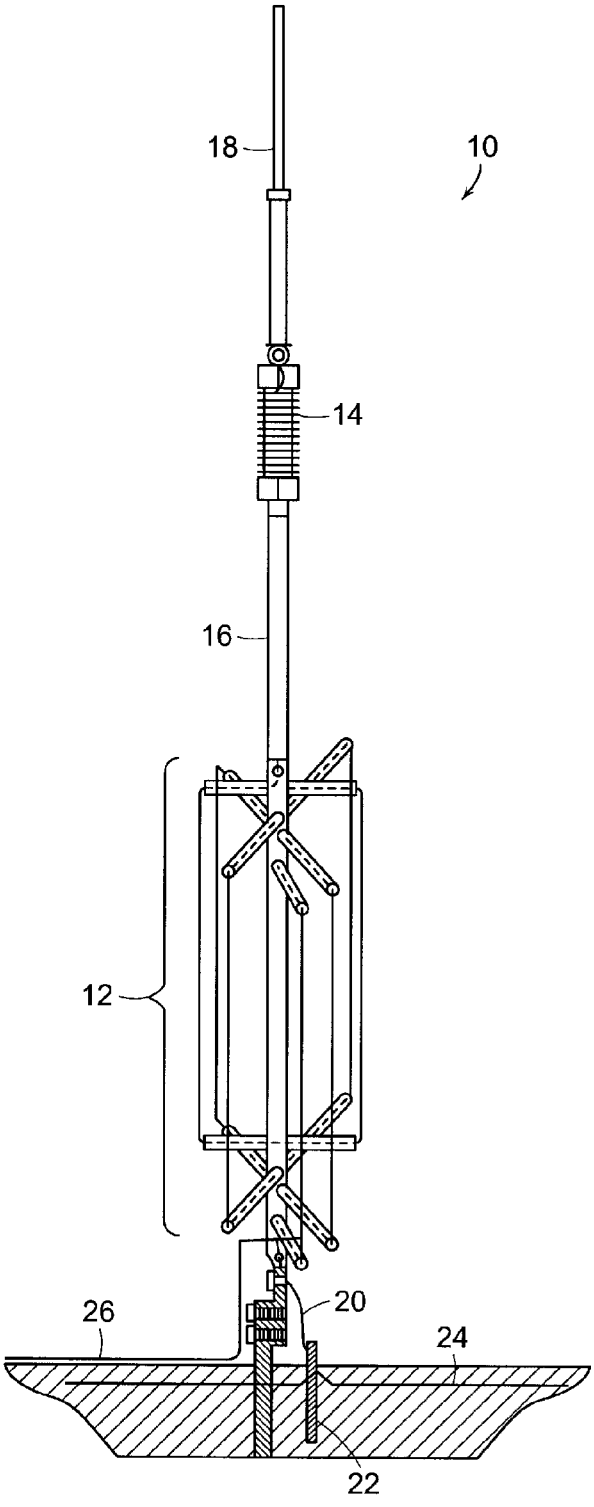
FIG. 1 shows an illustrative diagrammatic view of a distributed load monopole antenna system in accordance with an embodiment of the invention.

As shown in FIG. 1, a diagrammatic view of an antenna system 10 of the invention includes a radiation resistance unit 12 and a current enhancing unit 14. The radiation resistance unit 12 is formed of a three-dimensional cage structure as discussed in more detail below.

The current enhancing unit 14 (such as, for example, a load coil) may be formed of a variety of conductive materials and may be formed in a variety of shapes. The unit 14 is positioned above the unit 12 and is separated a distance above the unit 12 and supported by a conductive mid-section 16 (e.g., aluminum tubing). The current enhancing unit 14 when placed a distance above the radiation resistance unit 12 performs several important functions. These functions include raising the radiation resistance of the helix and the overall antenna. The antenna system 10 also includes a conductive top section 20. Each winding, therefore, includes an elongated portion that is substantially parallel with the elongated central axis of the monopole antenna. The elongated portions of each winding positioned at a plurality of angularly disposed locations around the elongated central axis of the monopole antenna.

Figure 2:
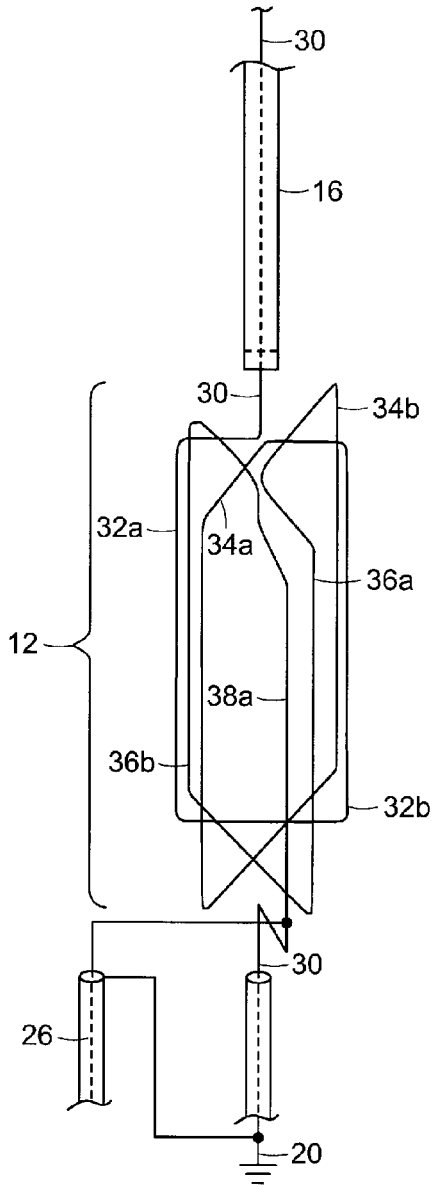
FIG. 2 shows an illustrative diagrammatic circuit of a portion of the distributed load monopole antenna shown in FIG. 1.

The antenna provides continuous electrical continuity from the base of the antenna to the top of the antenna conductive metal 18. The base of the antenna is grounded by a ground wire 20 coupled to a ground post 22 and spoke-like ground wires 24. The signal to be transmitted may be provided by a coaxial cable 26 at any point along the radiation resistance unit 12 (e.g., near but not at the bottom of the unit 12). The signal may also be optionally passed through a capacitor in certain embodiments to tune out excessive inductive reactance in certain embodiments. The signal conductor of the coaxial cable 26 is coupled to one of the lower radiation resistance unit windings near the base as shown in FIG. 2, and the outer conductor of the coaxial cable is coupled to ground as also shown in FIG. 2. FIG. 2 shows an illustrative diagrammatic view of the circuit of a portion of the antenna shown in FIG. 1. As shown in FIG. 2, a single conductor 30 extends from the mid-section 16, through a plurality of three-dimensional windings in the radiation resistance unit 12, and is ultimately grounded at the base of the antenna. The outer conductor of a coaxial conductor 26 is also grounded, with the transmission signal being delivered from the center of the coaxial conductor 26 to a tap along a winding of the radiation resistance unit 12.

The choice of the distance of the load coil above the helix impacts the average current distribution along the length of the antenna. The average current distribution over the length of the antenna varies as a function of the mid-section distance for a 7 MHz distributed load monopole antenna. The conductive mid-section has a length that provides that a sufficient average current is provided over the length of the antenna and provides for increasing radiation resistance.

The inductance of the load coil should be larger than the inductance of the radiation resistance unit. For example, the ratio of load coil inductance to radiation resistance unit inductance may be in the range of about 1.1 to about 2.0, and may preferably by about 1.4 to about 1.7. In addition to providing an improvement in radiation efficiency of a radiation resistance unit and the antenna as a whole, placing the load coil above the radiation resistance unit for any given location improves the bandwidth of the antenna as well as improves the radiation current profile. The radiation resistance unit and load coil combination are responsible for decreasing the size of the antenna while improving the efficiency and bandwidth of the overall antenna. In further embodiments, a top unit may be include a top section (e.g., one or more conductive spokes) that extends from the upper portion of the antenna above the conductive section 18 in a radial direction that is orthogonal to the vertical axis of the antenna itself. The use of such a top unit may further reduce the inductive loading of the radiation resistance unit and load coil to allow even wider bandwidth and greater efficiency. The top unit is included as part of the current enhancing unit. In further embodiments, the top unit may be used in place of the load coil as the current enhancing unit.

The radiation resistance unit 12 of the system of FIGS. 1 and 2 provides a wider bandwidth than a distributed monopole antenna system as disclosed in U.S. Pat. No. 7,187,335 that includes a helix as a radiation resistance unit. As shown in FIGS. 1 and 2, the radiation resistance unit 12 includes vertically extending windings that are positioned radially from the center axis of the antenna. In particular, the conductor 30 extends from the mid-section 16 down winding 32*a*, up winding 32*b*, down winding 34*a*, up winding 34*b*, down winding 36*a*, up winding 36*b* and finally down winding 38*a*. The radiation resistance unit 12, therefore, is wound from top to bottom rather than around in a spiral or helix. In accordance with various embodiments, the windings may include any number of return windings such as two and one half windings or three and one half windings (three and one half are shown in FIGS. 1 and 2). The return path may also be provided as a ½ winding (as shown at 38*a*), or may be provided along the antenna axis.

A radiation resistance unit of the invention was implemented on a 30 meter radial system or radial lengths of about 15 feet. The frequency of the test was 7.0 MHz. These radials are about half of the normal length and also half the normal numbers of radials were employed. The field level measured in comparison to the conventional three dimensional helix distributed load monopole antenna at 7.0 MHz was +1.5 db better for the radiation resistance unit design of the above embodiment. This indicates that the radiation resistance unit of embodiments of the invention will provide better performance over marginal ground systems than will a conventional distributed load monopole antenna that includes a helix for the radiation resistance unit.

Figure 3:
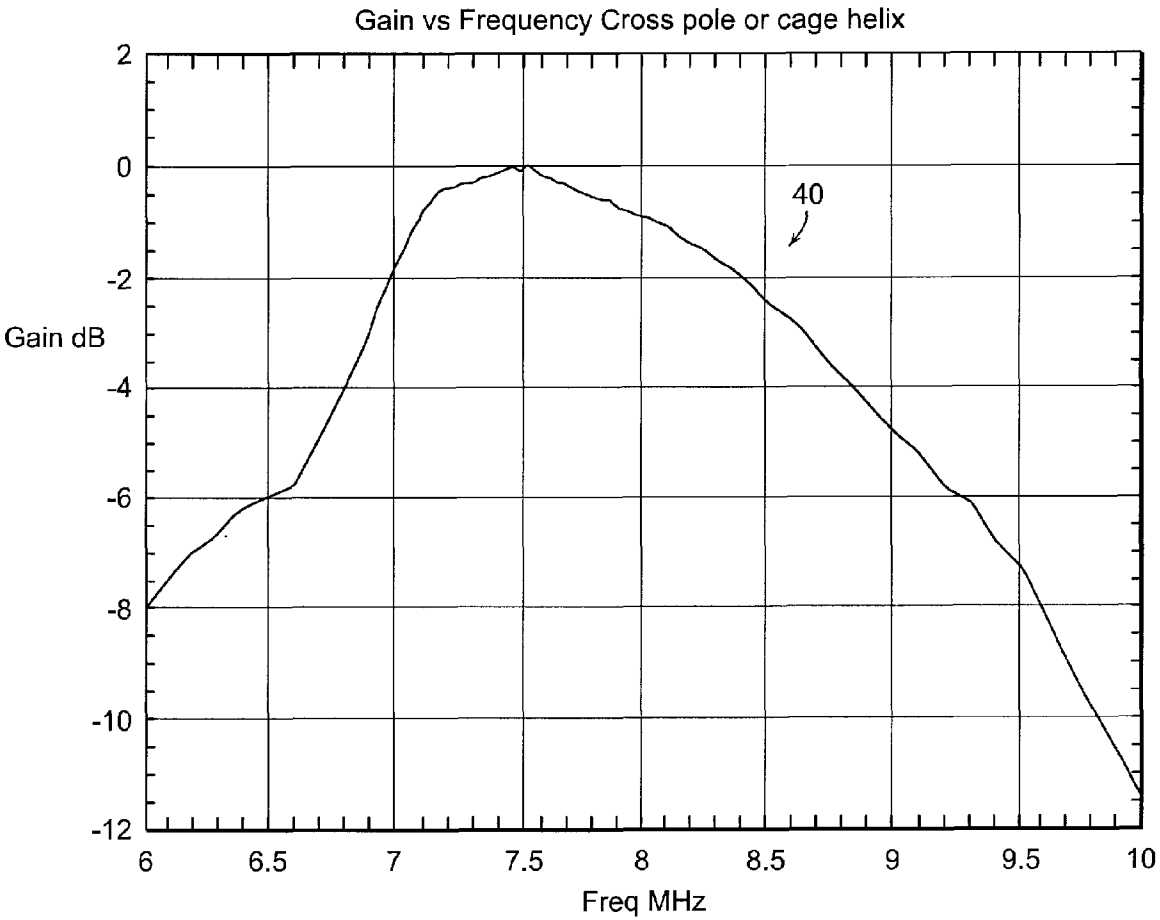
FIG. 3 shows and illustrative graphical view of the gain versus frequency for an operating frequency range of a system in accordance with an embodiment of the invention.
Figure 5:
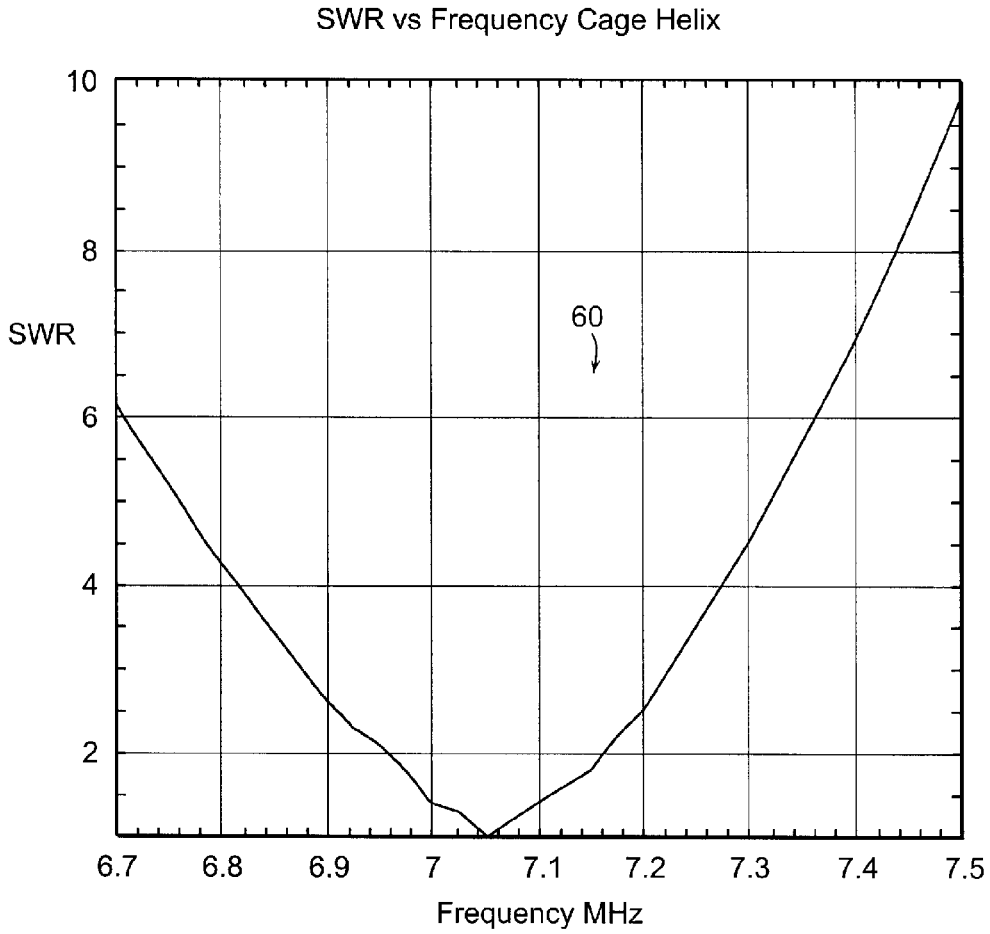
FIG. 5 shows an illustrative graphical view of the data shown in FIG. 4.

FIG. 3 shows at 40 the relationship of gain as a function of frequency for a system in accordance with an embodiment of the invention. Even with a high standing wave ratio (SWR) the antenna still provides good radiation efficiency. FIG. 4 shows at 50 data for the SWR as a function of frequency for a portion of the frequency range shown in FIG. 3. FIG. 5 shows at 60 the relationship of SWR as a function of frequency for a system in accordance with an embodiment of the invention.

In accordance with a further embodiment, the invention also provides a system and method for tuning a distributed load monopole antenna in accordance with an embodiment of the invention. Distributed load monopole antennas are normally designed to operate within a specific bandwidth as defined by the center frequency of the antenna design. These parameters are determined by the size of the antenna and values of inductance for the helix and load coil. With the helix radiation resistance units it is difficult to vary inductance and thus vary center operating frequency. Although certain adjustment methods exist for adjusting a distributed load monopole antenna, such adjustment methods generally provide frequency variation of the antenna operation as much as 20%. The proposed method of changing the inductance of the radiation resistance unit when combined with the variable top section adjustment allows continuous frequency variations of the antenna operation by, in some cases by more than four octaves. For example a 7 MHz spiral distributed load monopole antenna using these methods allowed operation from less than 6 MHz to higher than 18 MHz. This is a change in frequency of better than three octaves or more than 300%. In addition, operation of the antenna at higher frequencies results in as much as +6 db higher gain than could be achieved with a comparable antenna designed for a single frequency of operation.

Figure 6:
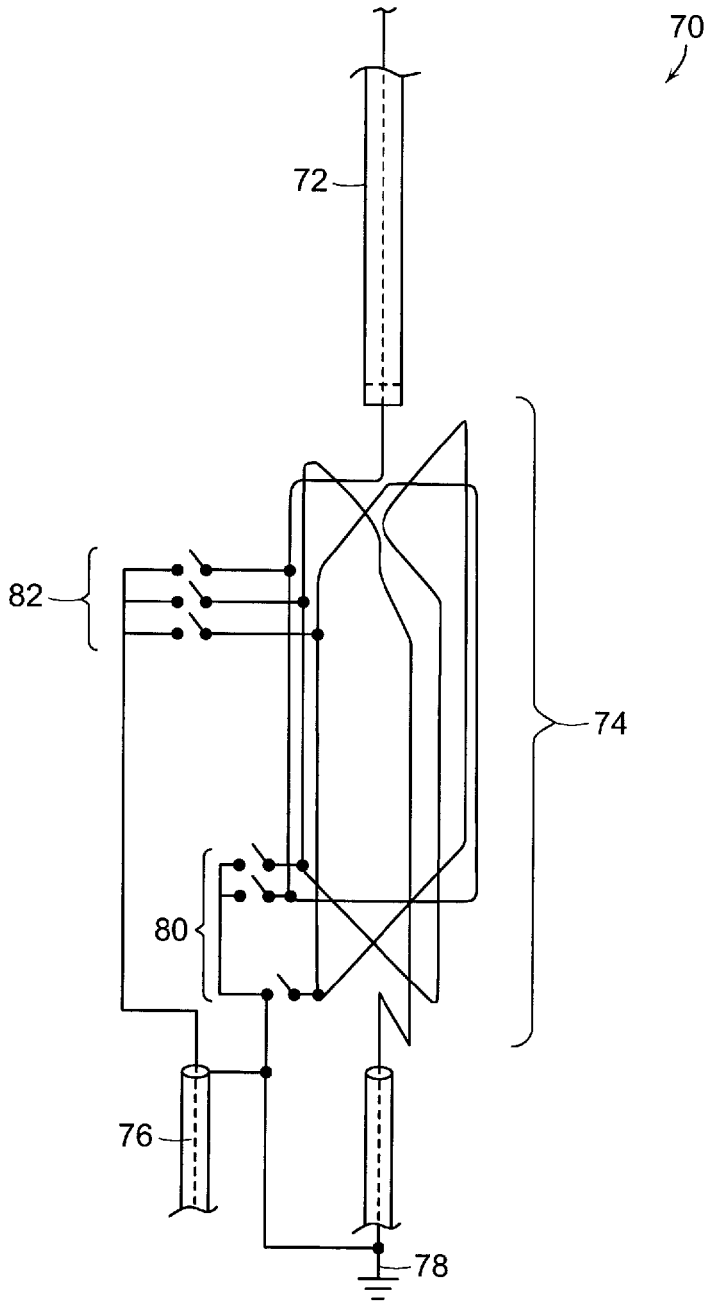
FIG. 6 shows an illustrative diagrammatic view of a system in accordance with another embodiment of the invention that provides adjustment of the antenna operating parameters.

FIG. 6 shows at 70 a system in accordance with a further embodiment of the invention in which a distributed load monopole antenna includes a mid-section 72, an adjustable radiation resistance unit 74, a coaxial cable connector 76 and a ground connection 78. The adjustable radiation resistance unit 74 includes winding as discussed above with reference to FIGS. 1 and 2, but also include a plurality of switches that are coupled to the windings. In particular, switches 80 govern which winding will terminate at ground, and switches 82 govern which winding will be coupled to the signal from the coaxial connector 76. By combing the actuation of the switches, the effective number of windings of the radiation resistance unit 74 may be changed, for example from three and one half windings to two and one half windings.

Figure 7:
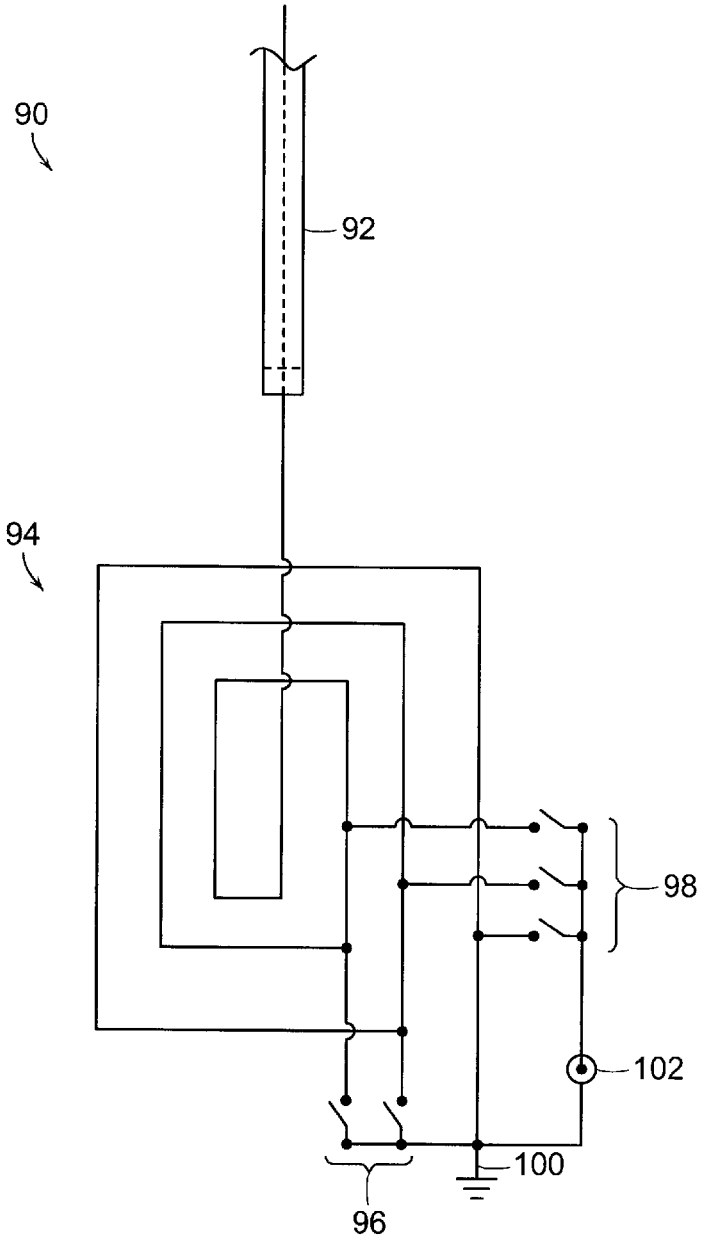
FIG. 7 shows an illustrative diagrammatic view of a system in accordance with a further embodiment of the invention employing a plano-spiral helix that provides adjustment of the antenna operating parameters.
Figure 8:
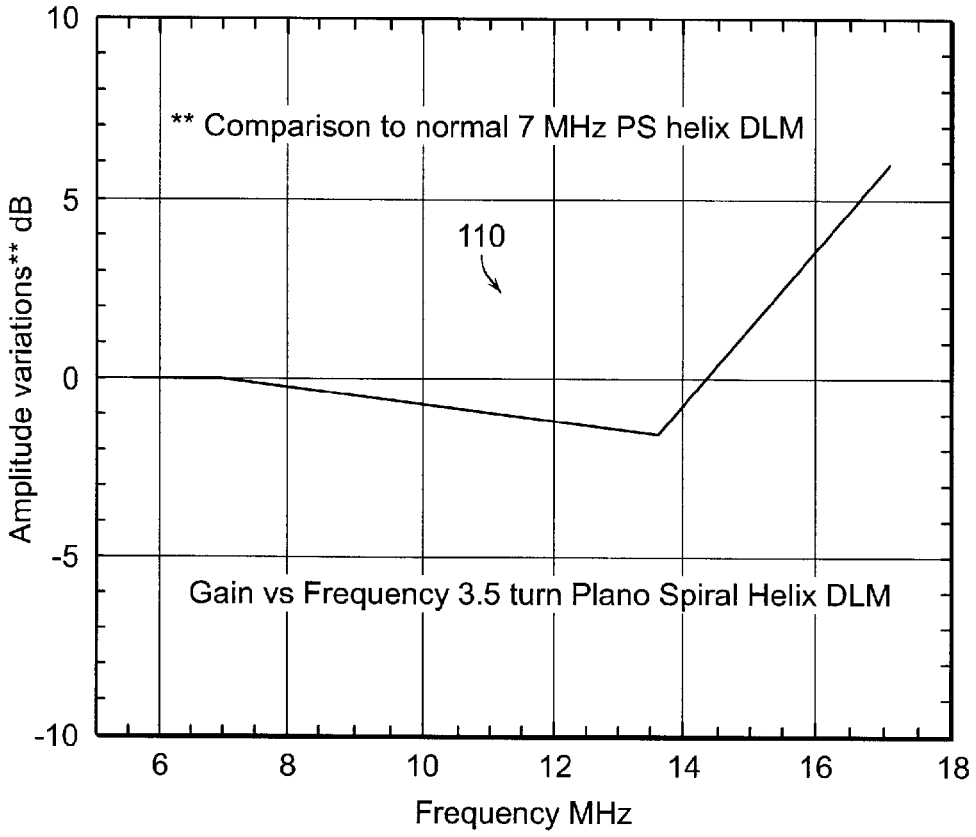
FIG. 8 shows an illustrative graphical view of measured field level amplitudes versus frequency for a system in accordance with an embodiment of the invention.

As shown at 90 in FIG. 7, an adjustable radiation resistance unit in accordance with an embodiment of the invention may also be provided as a plano spiral. The system 90 includes a mid-section 92, plano-spiral radiation resistance unit 94, a plurality of switches 96 that govern which winding will terminate at ground 100, and a plurality of switches 98 that govern which winding will be coupled to the signal from the coaxial connector 102.

A non-adjustable plano-spiral radiation resistance unit is generally designed with two and one half turns of a conductive metal. This may be wire, tubing, metal strap or a copper trace of a printed wiring board. In the embodiment shown in FIG. 7, a 2.5 turn of wire helix is changed and made of 3.5 turns. This allows lower frequency of operation with slight decrease in the level of higher end of its frequency range. As shown, various turns of the helix are shorted to ground and the antenna feed point is also changed. This allows very coarse variations of the antenna operating frequency. In order to fill in the gaps of this coarse frequency change the top section is varied in length. In some cases the load coil is also changed by tapping the number of turn used for each application. The variation of all three of these parameters allows a continuous frequency change in the antenna operation. For each variation of these three parameters there exists a defined bandwidth that the antenna will still operate over with no changes being made to any of the previously described antenna elements. The present embodiment, therefore, provides a method of changing the operating frequency of the antenna without sacrificing any level of performance.

Figure 9:
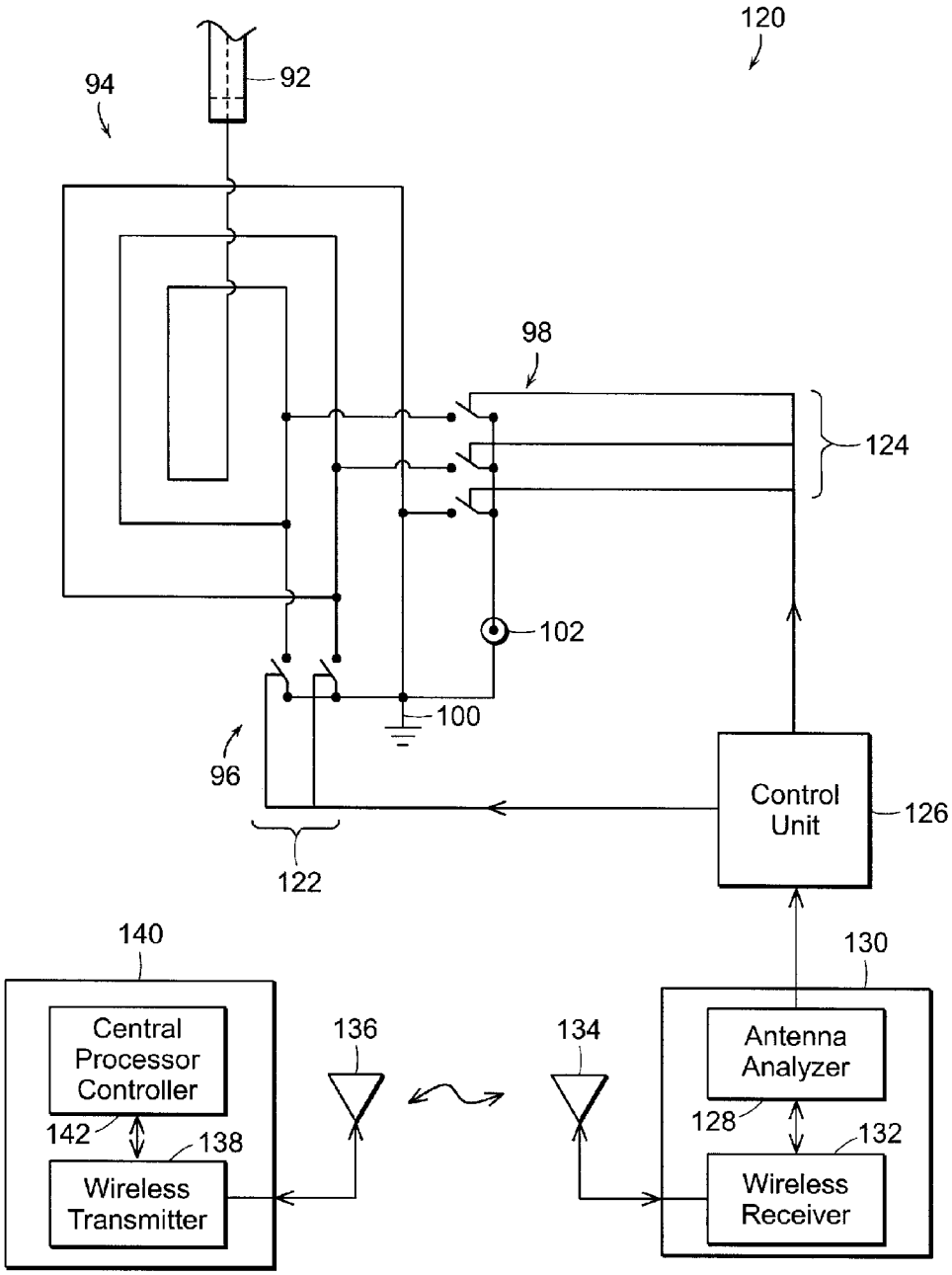
FIG. 9 shows an illustrative diagrammatic view of a system in accordance with a further embodiment of the invention.

In accordance with a further embodiment, the invention provides an adaptive smart antenna system in which switches as discussed above are controlled by a wireless control system. As shown in FIG. 9, such a system 120 may include an adjustable radiation resistance unit as discussed above with reference to FIG. 7 that includes the mid-section 92, the plano-spiral radiation resistance unit 94, the plurality of switches 96 that govern which winding will terminate at ground 100, and the plurality of switches 98 that govern which winding will be coupled to the signal from the coaxial connector 102.

As shown in FIG. 9, the system further includes control signal connectors 122 for controlling the switches 96, and control signal connectors for controlling the switches 98, as well as an antenna switch control unit 126 for providing the control signals to the switches 96 and 98. The control unit 126 receives its instructions from an antenna analyzer 128 of a remote control device 130, and the antenna analyzer 128 receives its command signals from a wireless receiver 132. The wireless receiver 132 is coupled to an antenna 134 and receives signals from an antenna 136 that is coupled to a transmitter 138 of a central control device 140. The transmitter 138 is also coupled to a central processor controller 142. The antenna analyzer 128 may be, for example, an AIM430 Antenna Analyzer Interface product as sold by W5BIG of Richardson, Tex.

The central processor controller 142 generates the command instructions for the control of the switches for both the ground termination (switches 96) and the tap points on the windings (switches 98). These instructions are sent via the transmitter 138 to the receiver 132 of the remote control device 130, and the control unit 126 causes the switches to be adjusted in accordance with the instructions as determined to be necessary by the antenna analyzer 128.

This invention therefore provides for the development of an Adaptive Smart Antenna (ASA) in accordance with the present embodiment that has many applications in cellphones and wireless systems. In addition, antennas in accordance with various embodiments of the invention may be used in medical applications for patient monitoring. Further commercial applications may include the use of these inventions for development of antenna arrays for use in high frequency radar used to measure sea and ocean states and to predict the occurrence of tsunamis, as well as to measure ocean and river currents.

This control system permits distributed load monopole antennas, whether alone or in a multi-antenna system, to be controlled in real time. Current antenna tuning control and frequency changing allows for manipulation of one set of antenna parameters and/or selection of individual antennas as needed. The system described herein allows not just selection and control of one or two antenna parameters but a whole range of parameters and/or antennas without one physical connection to the antenna. The system permits the control and variation of antenna parameters for changing antenna frequency and performance of a single antenna as well as any number of antennas that, for example, form arrays of antennas.

Figure 10:
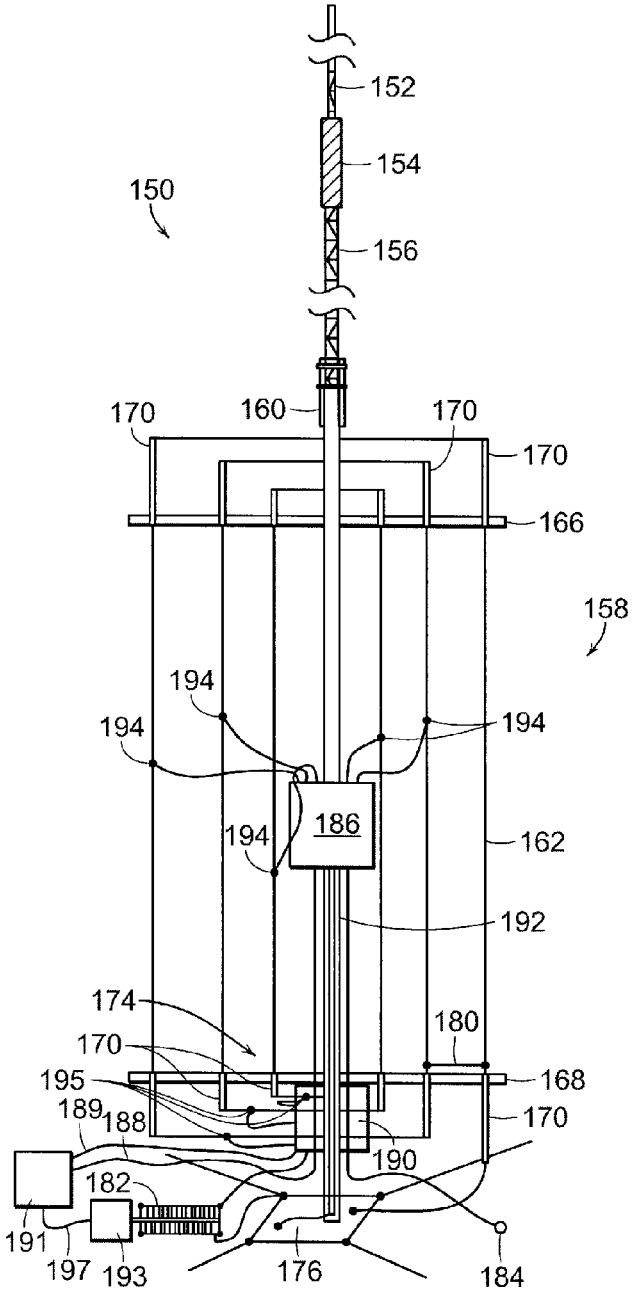
FIG. 10 shows an illustrative diagrammatic view of a frequency adjustable distributed load monopole antenna in accordance with a further embodiment of the invention.
Figure 11:
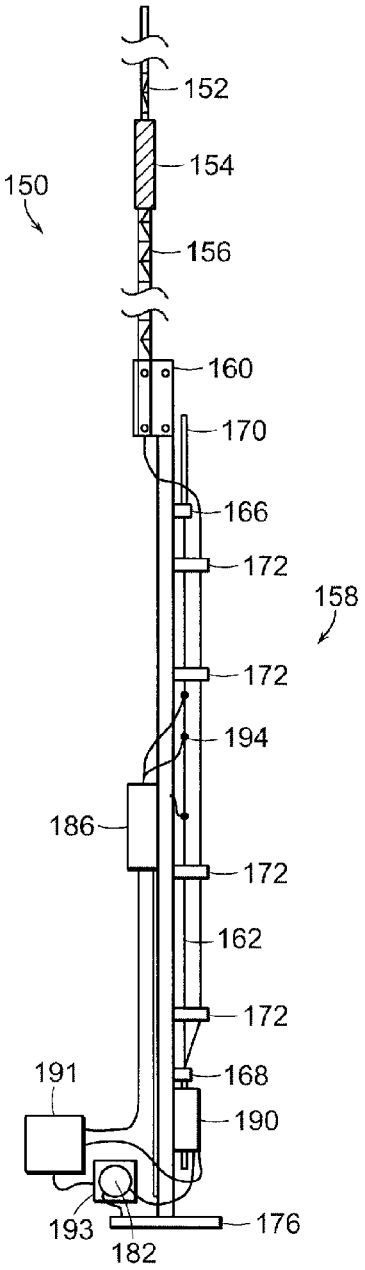
FIG. 11 shows an illustrative diagrammatic side view of the antenna of FIG. 10.

FIGS. 10 and 11 show at 150 a distributed load monopole antenna in accordance with a further embodiment of the invention. The antenna 150 includes a top section 152, a current enhancing unit 154 (e.g., a load coil), a mid-section 156 and a radiation resistance unit 158 that is coupled to the mid-section 156 by a metal mid-section mounting plate 160. The radiation resistance unit 158 includes a wire 162, which may or may not be insulated, and the wire 162 forms a helix as shown. The wire is supported in the shape of the helix by a fiberglass frame that includes a vertical member 164 and two cross members 166 and 168. Each cross member 166, 168 includes vertical spacers 170 as shown, and the vertical member 164 includes stand-offs 172 as shown. The radiation resistance unit, therefore, includes a plurality of windings that are substantially parallel with an elongated central axis of the monopole antenna.

The wire 162 is attached to the metal mid-section mounting plate 160, passes down the backside of the vertical support member 164 along the stand-offs 172, then begins a first loop as shown at 174 by passing through spacers 170 nearest the vertical support member 164, and then forms additional loops by passing through further spacers 170 until it terminates at a radial ground system 176 as shown at 178 that includes a ground plate and spoke-like ground wires. An optional jumper 180 or switches may be employed between different loops in order to permit changing the helix such as discussed above with regard to the switches 80, 82 of FIG. 6 and switches 96, 98 of FIG. 9.

In particular, a coaxial feed line is provided as shown at 184 to an antenna tap control unit 186 (e.g., via an SO-239 coax connector). As discussed further below with reference to FIG. 13, the antenna tap control unit 186 includes a plurality of relay switches that are controlled by an antenna tap control signal provided by a tap control input 188. The antenna tap control unit 186 is also electrically connected to ground via a conductive (e.g., aluminum) strip 192 and is coupled to a plurality of tap points on various loops of the helix of the radiation resistance unit 158 as shown at 194. The tap locations 194 may be provided by use of electrically conductive clips. As discussed further below, responsive to the tap control input 188, the feed line 184 is electrically coupled to a selected one of the tap points 194.

Also included in the embodiment of FIGS. 10 and 11 is a capacitor circuit that may be selectively coupled to one of the loops of the helix of the radiation resistance unit 158 at a first connection lead, and is coupled to ground at a second connection lead. The capacitor circuit, for example, may include a capacitor or variable capacitor 182 as shown. Varying the capacitance of the variable capacitor will achieve different operating characteristics such as tuning of the antenna.

The variable capacitor 182 is connected at one side to ground 176, and at the other side to a capacitor tap and short select switching unit 190. An operator control unit 191 is coupled to both the capacitor tap and capacitor tap and short select switching unit 190 as well as to a DC motor 193 that controls, via a motor control signal 197, the variable capacitor 182. As discussed further below, the operator control unit 191 also controls, via a switching network within the capacitor tap and short select switching unit 190, which loop of the helix of the radiation resistance unit to which the capacitor 182 is coupled as shown at 195. The capacitor control and short select switching unit receives a control signal 189 from the operator control unit 191, and the control signal 189 comprises a plurality of individual control lines that are provided via a ribbon cable. The tap control input 188 may also pass through the capacitor control unit 191 to provide a common antenna control signal path from the operator control unit.

The capacitor is therefore, a functional part of the antenna, and the frequency response of the antenna will be dictated, in part, by the size and placement of the capacitor. By switching the connection of a fixed capacitor to different loops, the frequency response of the antenna will change, and by adjusting a variable capacitor, the frequency response of the antenna will also change.

The range of frequency adjustment using such a variable capacitor for an antenna that operates at a frequency $f_n$ may be three and one half octaves above $f_n$ (up to 3.5 $f_n$). Depending on the octave chosen this frequency segment may be as large as several mega-Hertz. The antenna of FIGS. 10 and 11 utilizes a plano spiral helix as shown and bands of frequencies are selected 1) by alternately shorting out various helix windings as discussed above with reference to FIG. 9, and/or 2) by changing the tap point along any one segment of the helix as discussed above with reference to FIG. 9, and/or 3) by changing the capacitance of the variable capacitor. The tap point is chosen to provide a 50 ohm match for connecting to a signal source or receptor or both as desired.

The plano spiral helix is constructed on a frame made of fiberglass tubing and in an embodiment the frame may be 12 feet long with 5 foot wide cross members (166, 168). The main center frame may be a 2 inch square fiberglass tubing and the cross members are 1.5 inch square fiberglass tubing. The vertical spacers 170 of formed of various lengths to provide for the desired shape of the plano spiral wire helix as shown.

The aluminum strip 192 is fixed to the center fiberglass element on the opposite side of the helix windings. It is important that the center winding of the helix which connects to the mid section is spaced several inches from the frame as shown to reduce stray coupling capacity that may adversely affect the antenna tuning range provided by the tuning capacitor.

The variable tuning capacitor may be connected as shown, and in accordance with further embodiments, it may be coupled via a switching network as discussed above with reference to the network 96 of FIG. 9 to any of the loops of the helix. Similarly, the input signal may be coupled to any number of different feed points on the helix via a switching network such as shown at 98 in FIG. 9 and discussed above. Any combination of such adjustments may be employed to obtain a desired operating frequency and antenna configuration within a range of selected frequencies. The antenna, for example, may provide a 2:1 standing wave ratio (SWR) match over the selected band of frequencies at a nominal impedance of 50 ohms. If better then 50 ohms match is desired the feed point may be moved and selected by control relays as discussed above. Additionally the various shorting of plano spiral elements used to select the various octave bands may also be selected by additional relays. A controller unit, remotely located may allow for octave band selection, matching tap selection (as also discussed above with reference to FIG. 9) and capacitor selection or capacitance adjustment of the variable capacitor may also be provided by such a controller unit.

The capacitor breakdown voltage depends on the transmitting power applied to the antenna and for large transmitting power a large voltage breakdown is required. The selection of helix shorts and tap points is not limited within any one octave and several band of frequencies may be selected within that octave if needed.

The variable capacitor used in various embodiments of the invention as disclosed herein may be mechanically controlled (such as a rotary variable capacitor, a sleeve and plunger vacuum variable capacitor, or a slider variable capacitor), electronically controlled (such as variable capacitance diodes for low signal amplitudes) or digitally tunable (such as the DuNE™ digitally tunable capacitor product sold by Peregrine Semiconductor Corporation of San Diego, Calif.). A variety of mechanically controlled capacitors are available from Jackson Brothers of Leicester, United Kingdom, and many variable vacuum capacitors are available from Jennings Technology, Inc. of San Jose, Calif., and from Comet AG of Flamatt, Switzerland. A network of high voltage ceramic capacitors may also be used together with a variable switching circuit for selectively connecting a plurality of such high voltage ceramic capacitors in series and/or parallel in order to change an overall capacitance provided by the network of high voltage ceramic capacitors. The variable capacitor may also be provided within a weather sealed enclosure together with a DC motor for controlling the variable capacitor, as well as a feedback circuit for informing the user how much capacitance is being provided by the variable capacitor.

In accordance with the embodiment discussed above with reference to FIGS. 10 and 11, a frequency range of 1.5 to 12 MHz may be provided, and the selection ranges may be 1.5 to 3 MHz, 2.5 to 5 MHz, 5 to 10 MHz and 8 to 12 MHz. This may be provided by an antenna of approximately 38 feet in height utilizing a 3.5 turn helix, a 16 foot mid-section and a top section as needed. The mid-section, top-section and load coil size as well as helix size determine the lowest operating frequency. A load coil of 70 μH may be used as the current enhancing unit, although myriad combinations of the above elements of different sizes and values may be employed to provide suitable performance over any desired frequency range.

An antenna control system in accordance with an embodiment of the invention (as, for example, the embodiment shown in FIGS. 10 and 11), may therefore include an antenna tap control unit, a capacitor control and short select switching system (including the DC motor and the capacitor tap and short select switching unit 190) and an operator control unit coupled to the antenna tap control unit and the capacitor control and short select switching system.

Figure 12A:
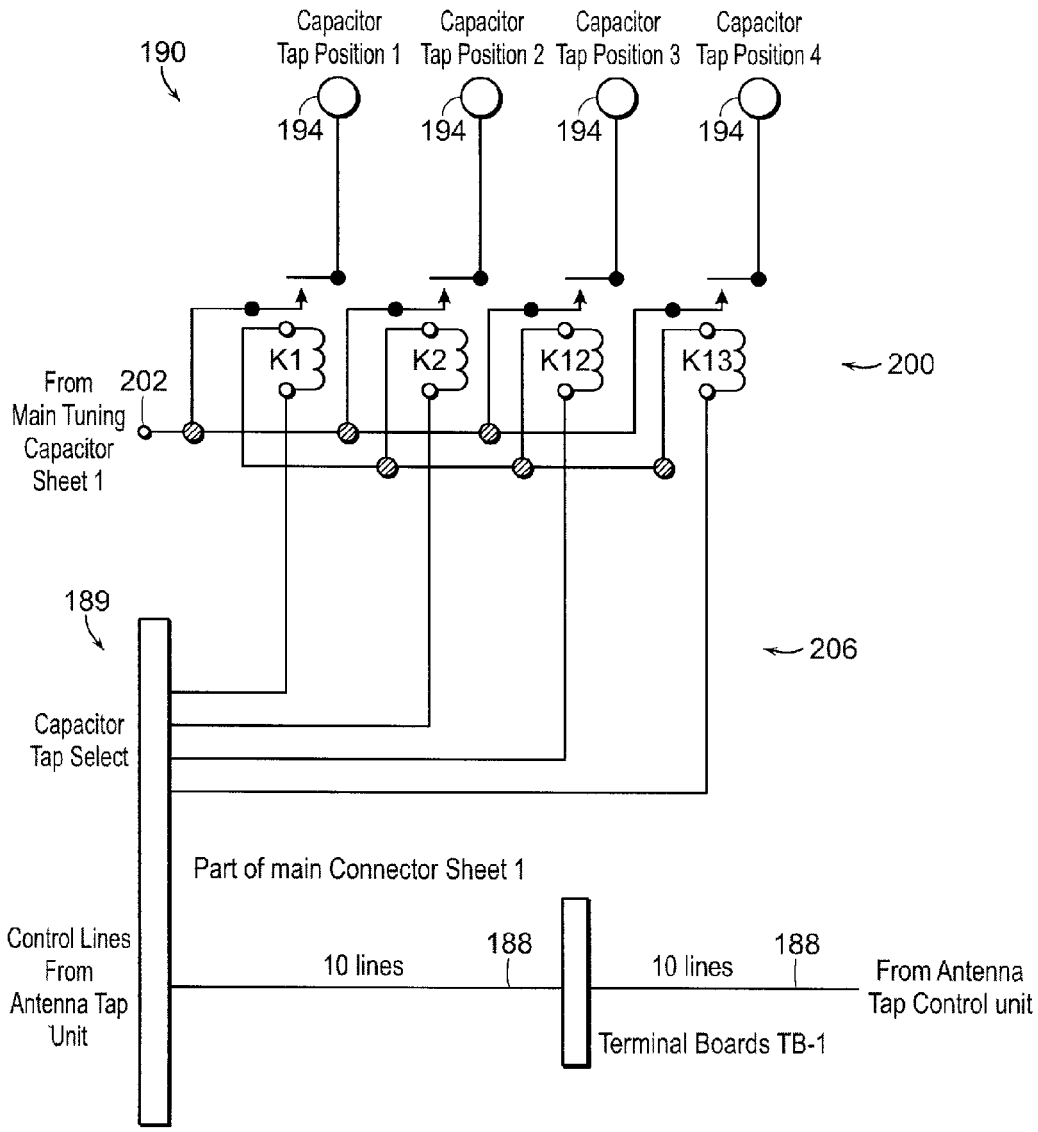
FIGS. 12A and 12B show illustrative diagrammatic schematic views of portions of the capacitor tap and short select switching unit of the embodiment of FIGS. 10 and 11.
Figure 12B:
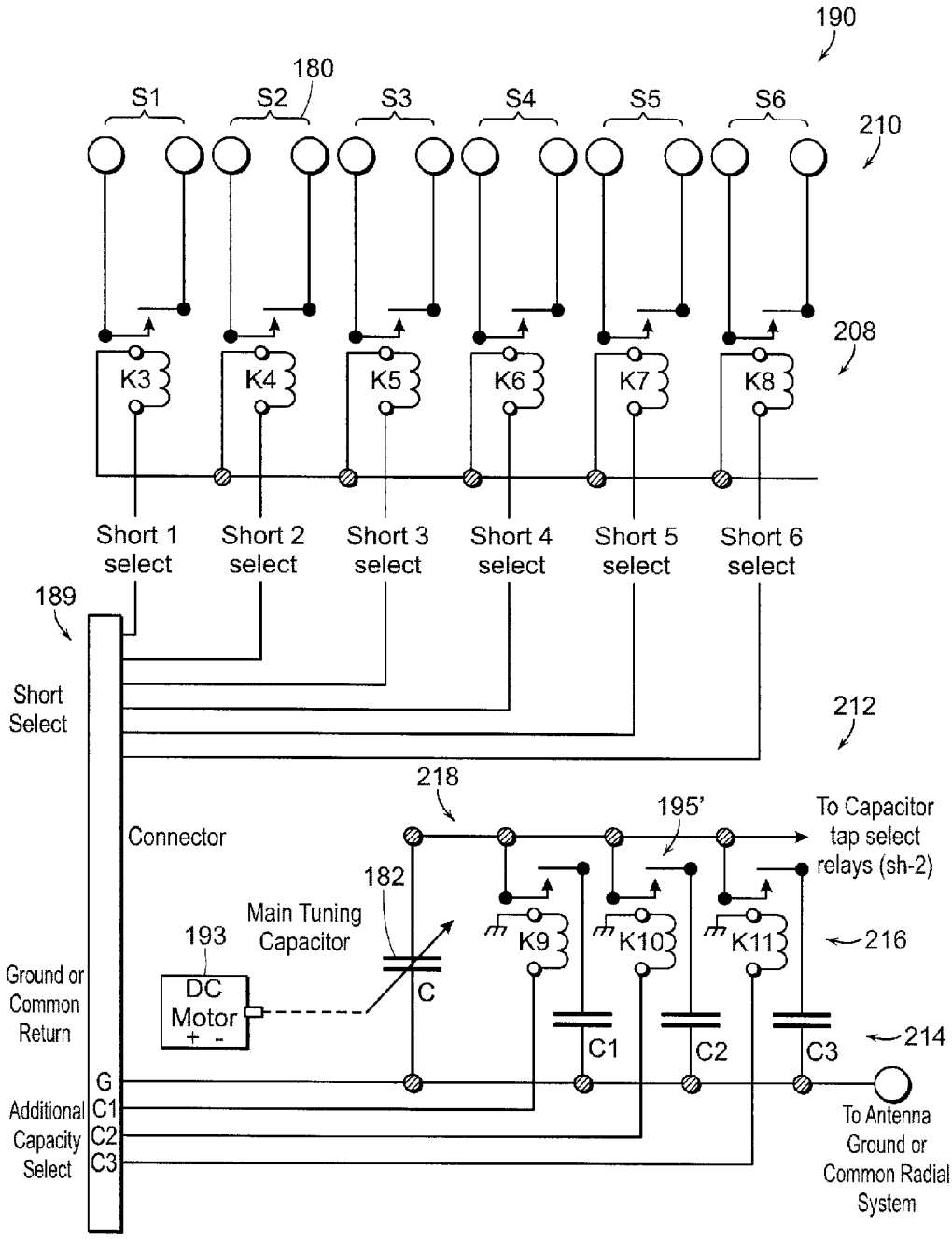

As shown in FIGS. 12A and 12B, the capacitor tap and short select switching unit 190 includes a plurality of relays 200 (K1, K2, K12, K13) that selectively couple a connection 202 from the main tuning capacitor (e.g., 182) to a selected one of a plurality of capacitor tap points 204. For example, if the relay K12 is activated, then the signal from the main tuning capacitor (e.g., 182) will be coupled to tap 195' as shown in FIG. 12A. Control of the relays is provided from the control line 189 (e.g., a ribbon cable), that includes a plurality of relay control signals 206. The tap control input 188 may pass through the unit 190 as shown.

The tuning capacitor is connected to the antenna at a predetermined point for each band selected. The relays K1, K2, K12, K13 need to be of a robust design also since the capacitor connection point along the helix may have an RF voltage that may exceed several thousand volts when relative high power is applied. For some bands of operation the capacitor connection point may not be changed and it is possible that two or three of the bands selected may use the same capacitor connection point.

As shown in FIG. 12B, the capacitor tap and short select switch unit 190 also includes a set of short select relays 208 that are coupled to a plurality of short circuit connections 210 for changing the helix of a radiation resistance unit (as diagrammatically shown for example at 180 in FIG. 10) by actuation of relay K4 as shown in FIG. 12B Again, control of the relays is provided from the control line 189 (e.g., a ribbon cable). The capacitor tap and short select switch unit 190 therefore, provides for individual helix shorting points as predetermined for each operating band selected. The shorting of the helix allows the overall antenna resonance to be tuned by the tuning capacitor. When the antenna is tuned, the driving point impedance as selected by the antenna tap control unit 190, will be approximately 50 ohms resistive over the entire band of operation. The maximum allowed SWR over the band operation should not be allowed to exceed 2:1. This means that the antenna driving impedance may vary between 25 and 100 ohms resistive.

As further shown in FIG. 12B, the tuning capacitor may be varied by the DC motor 193 connected to a capacitor shaft of a variable capacitor 182. In accordance with further embodiments, it may be desired to provide adjustable capacitance as provided by a switchable capacitor circuit 212 that includes capacitors 214 coupled to relays 216 (e.g., relays K9, K10 and K11) that may be switchably coupled to the capacitor tap select relays as shown at 218 (e.g., as shown at 195' by actuation of relay K10 in FIG. 12B. The relays K9-K11 may be of the high voltage mica, ceramic or fixed capacity vacuum capacitors but they also need to be of a robust design and need to be of the same order of breakdown voltage as the main tuning capacitor. The coupling of a variable capacitance in parallel to the capacitor 182 provides additional adjustment of the capacitance. In accordance with further embodiments, it may be desired to use a continuous rotation capacitor (e.g., if an air dielectric tuning capacitor is used); otherwise it will be required to have an end point detected so that the motor voltage may be reversed so that the capacitor will rotate in the opposite direction. If a vacuum variable capacitor is used (as may be recommended for certain applications) then the capacitor motor circuit becomes more difficult as it may be required to count shaft rotations and to provide for automatic motor reversing at the end points.

The tuning capacitor needs to be of the high voltage type and if an air dielectric capacitor is used the plate spacing must be capable of handling several thousands of RF volts. If vacuum capacitors are used then it must also have voltage rating so it will not break down. The capacitor if of the air dielectric design must be kept dry at all times as any dampness in the capacitor housing will lower the breakdown voltage of the capacitor. Capacitor arching can destroy a vacuum variable capacitor and seriously damage an air dielectric capacitor. For power operations of 1000 to 1500 watts air variable capacitors need at least a 3 to 5 thousand volt breakdown voltage and vacuum variable to be safe should be of the 10 Kv rating or higher. If much higher power levels are anticipated or high level amplitude modulation is being considered then the higher the capacitor breakdown voltage the better.

Figure 13:
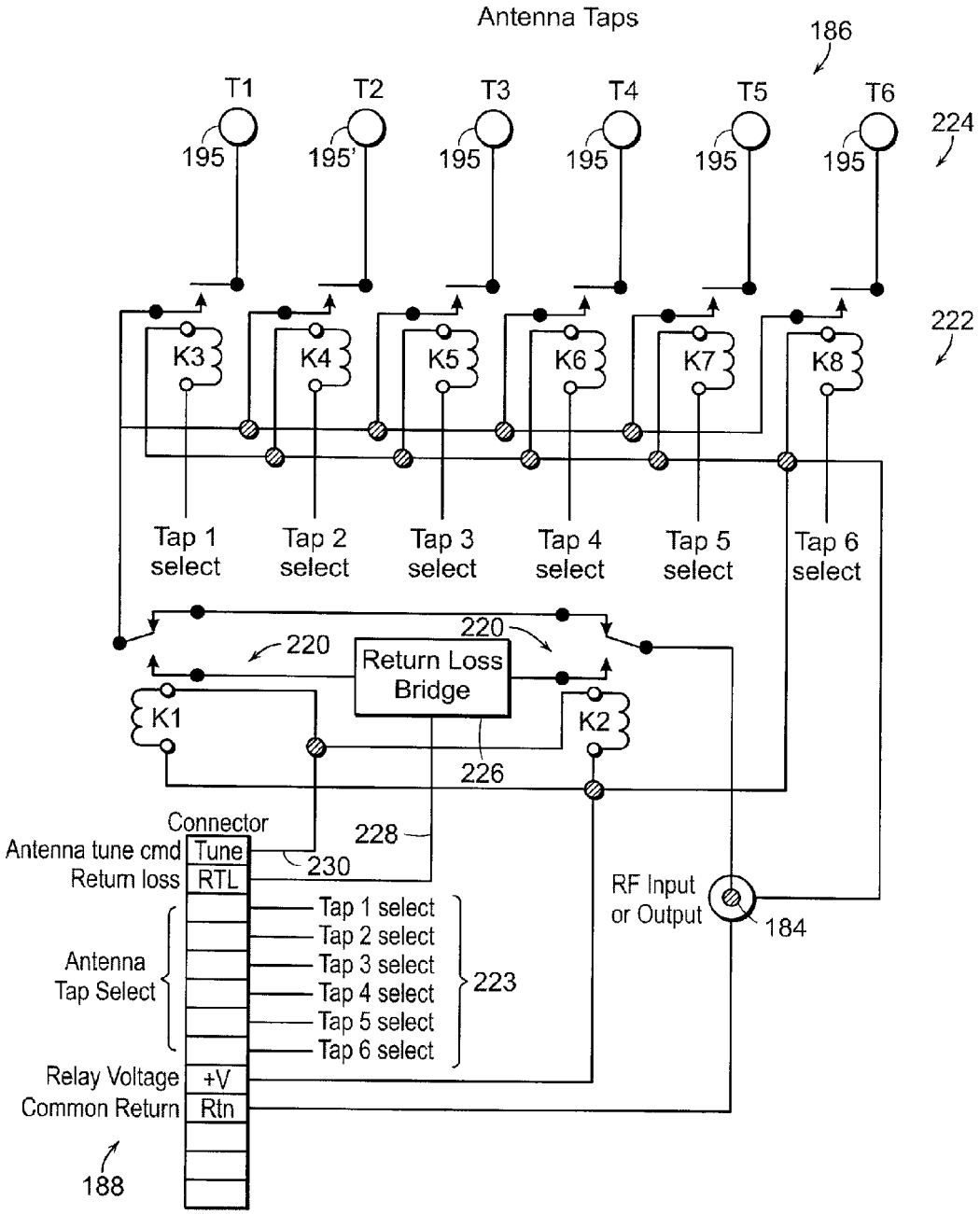
FIG. 13 shows an illustrative diagrammatic schematic view of the antenna tap control unit of the embodiment of FIGS. 10 and 11.

The relays K9, 10 and 11 are used to switch in if needed individual fixed value capacitors. Relays K3 through K8 (as shown in FIG. 13) provide antenna tap points as required to resonate the overall antenna to the frequency of operation. The relays K3-K8 should also be capable of handling the anticipated high voltages, and are also controlled by a switch in the operator control unit 191 as discussed further below.

In particular, the antenna tap control unit 186 includes eight relays (K1, K2 as shown at 220 for controlling return bridge loss and (K3, K4, K5, K6, K7 and K8 as shown at 222 (responsive to control signals 223) for controlling antenna tap connections) as well as required control lines (e.g., via a ribbon cable) from the operator control unit 191 to switch the RF input/output line 184 to any of a selected tap points 224 (such as tap point 195' by actuating the relay K4). Relays K1 and K2 allow selectable series connection of a return loss bridge 226 that provides an indication of antenna resonance and match for any frequency within a selected operating bandwidth. A return loss signal is provided to the control lines (e.g., two-way ribbon cable) as shown at 228, and an antenna tune command is provided as shown at 230.

Very little radio frequency power is required during the tuning process; a few watts of power from the radio transmitter or transceiver will give a very satisfactory indication. The helix tap relays (K3-K8) are selected from predetermined positions on the antenna helix for a proper match within the operating band selected. Radio frequency power from the transmitter or transceiver is connected to the RF input connector located on the antenna tap control unit 186. This is a standard 50 ohm coaxial connection. Relays K3 through K8 provide the selection of the required helix tap point as selected by the operator control unit 191. For each band of operation one switch in the operator control unit 191 S1 selects the proper helix tap point as well as the required helix shorting connection and tuning capacitor connection point. The connections are all predetermined for any one of the 6 bands selected. These relays need to be capable of handling high RF voltage as developed along the helix for the bands not selected. Since the impedance along any point of the helix except at the last turn is fairly low these voltage will be well within the capability of the relays used. These relays however, must also be capable of handling high RF current levels for the selected tap point as well, and must therefore, must be of a robust design.

Figure 14:
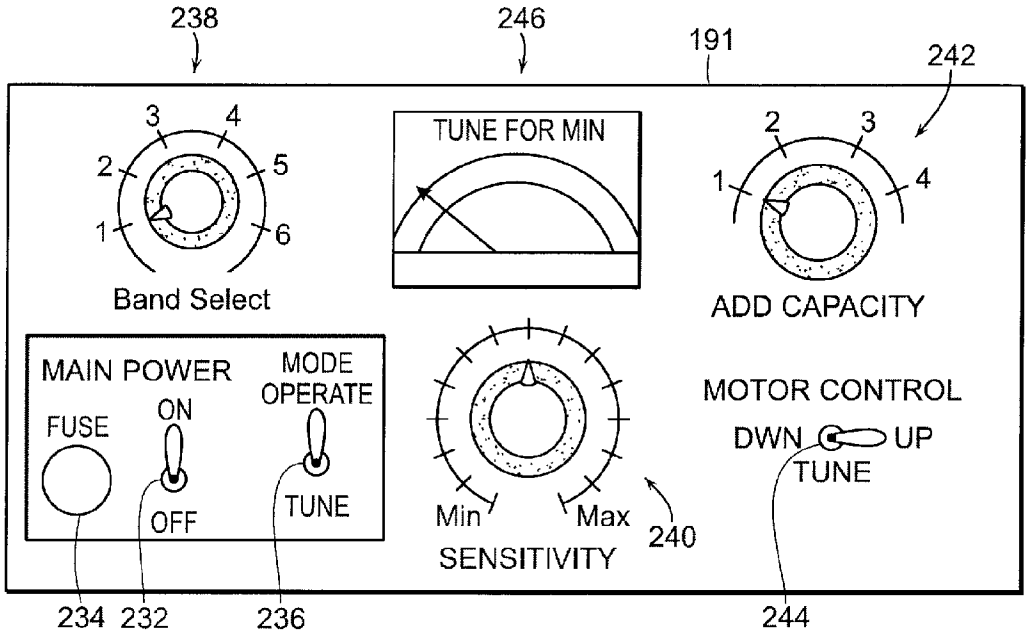
FIG. 14 shows an illustrative diagrammatic view of the operator control unit of the embodiment of FIGS. 10 and 11.

As shown in FIG. 14, the operator control unit 191 includes a main power on/off switch 232, a fuse 234, and a mode switch 236 for switching between operation mode and tuning mode. The operator control unit 191 also includes a band select control selector 238, a sensitivity selector 240 for a return loss indicator meter 246, and an add capacity selector 242. The operator control unit 191 further includes a motor control switch 244 for controlling the motor 193.

Figure 15:
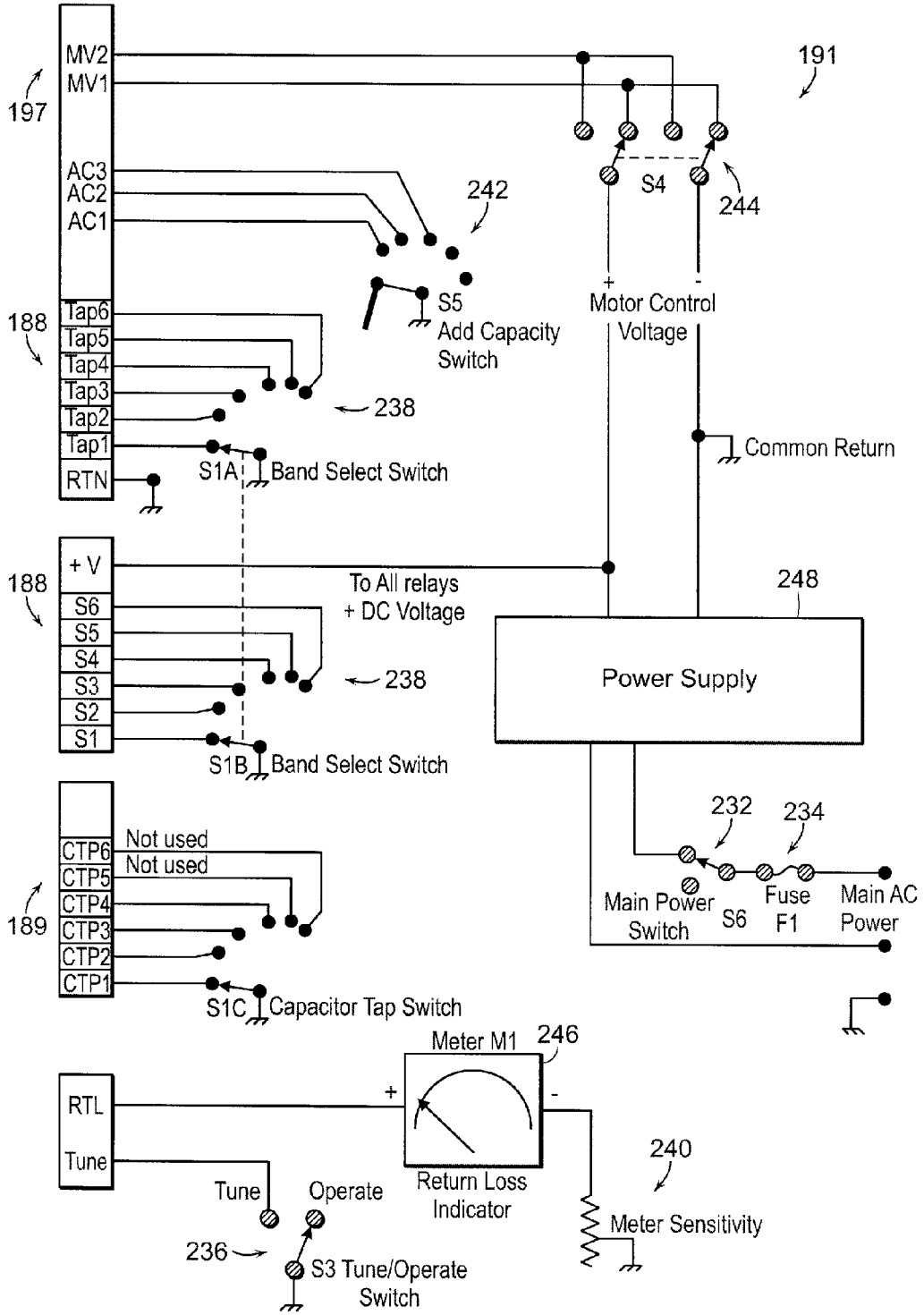
FIG. 15 shows an illustrative diagrammatic schematic view of the operator control unit of FIG. 14.

FIG. 15 shows a schematic view of the functional operation of the operator control unit 191 including the control functions as needed to allow the antenna to operate and to be tuned over a range of frequencies with a selected band as shown in FIG. 14 as discussed above with reference to FIG. 14. The power supply unit is provided as shown at 248, which is coupled via the main power switch 232 and fuse 234 to an alternating current supply. The return loss indicator meter 246 permits tuning of the antenna to the frequency of interest within any one band (as selected by the band select switch 238). The tuning capacitor control in this case assumes a continuous rotation variable capacitor as there is only a simple up down voltage reversing switch used for varying the tuning capacitor. Additional capacity is selected as needed by the add capacity selector 242; the relays 216 (K9 thou K11) will be always energized when maximum capacity is selected. The individual fixed capacitors 214 should allow increments of the variable capacitor) 82. As an example if a 25-600 pf capacitor is used for the variable capacitor then the individual fixed capacitors should be in 500 pf steps. This would allow for a full range of capacity from 25 to 2100 pf in essentially 500 pf steps with a variable step from 25 to 600 pf. One side of the capacitor or capacitors is always connected to ground.

Field tests have indicated measured field intensity from a loss of −1.5 db at the lowest frequency octave to greater than +5.7 db at the upper frequency ranges. Radiated field strength will vary within any one frequency octave. The increase in gain is achieved by lowering the radiation angle and flattening out the field pattern. This is similar to performance provided by ½, ⅝ and 1 wavelength vertical antennas as compared to a ¼ wave vertical antenna. At 7 MHz however, where a +5.7 db gain was achieved the overall height of the antenna still remained 38 feet. This provided improved performance when compared to a normal ⅝ or ⅜ wave antenna, which would be in excess of 90 feet total height.

Figure 16:
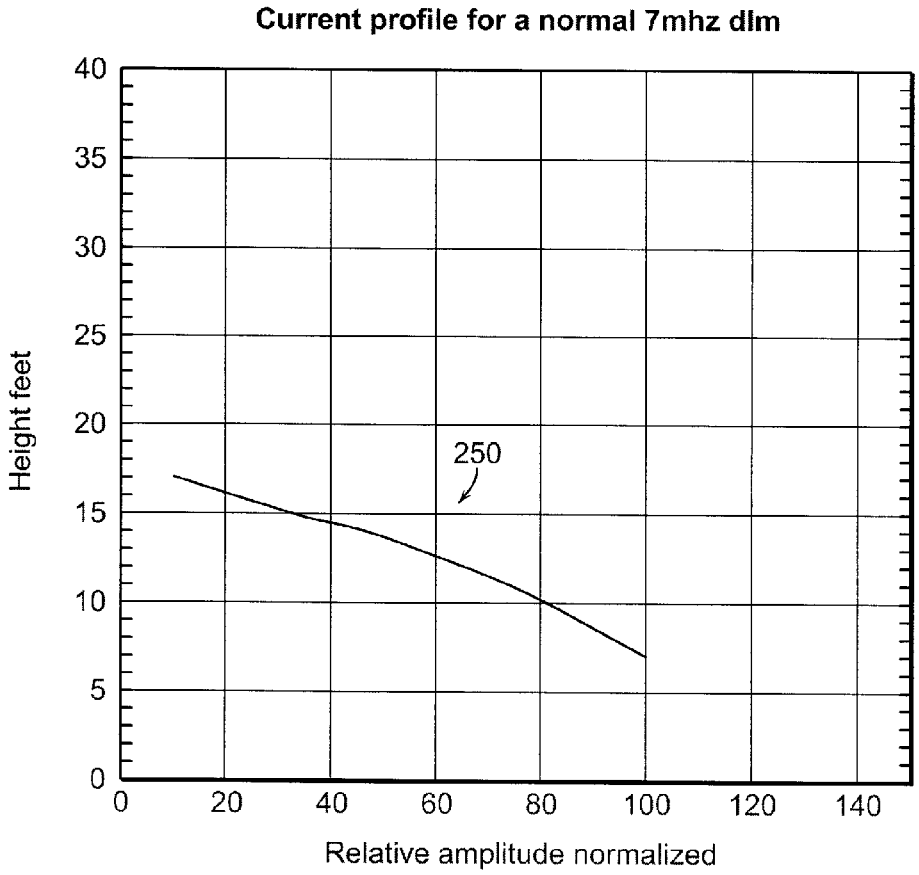
FIG. 16 shows an illustrative graphical view of a current profile 7 MHz distributed load monopole antenna.
Figure 17:
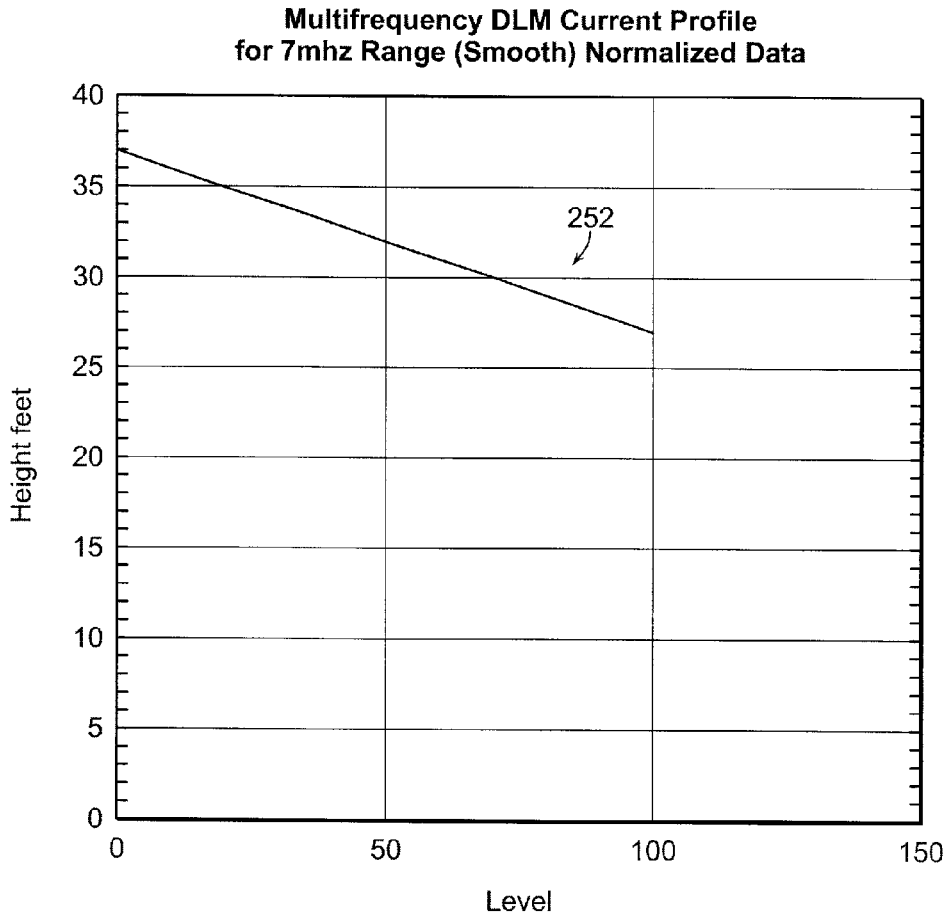
FIG. 17 shows an illustrative graphical view of a current profile 7 MHz range multi-frequency distributed load monopole antenna.

The increased radiation performance is achieved by a constant amplitude current profile from the antenna base to a height just below the load coil height. This provides a larger volume of radiation because the initial strength of the current profile at the helix base is 2.7 times greater than that provided by a ¼ wave antenna or another multiple of a wavelength for the same operating frequency with the same power into the antenna. FIG. 16, for example, shows at 250 a current profile for a normal 7 MHz distributed load monopole antenna, and FIG. 17 shows at 252 a current profile for a multi-frequency distributed load monopole antenna for a 7 MHz range (smooth) using normalized data. The bandwidth, as dictated by a 2:1 SWR level, is in some cases less than a standard DLM antenna. This is of little consequence however, since the antenna can be remotely electrically tuned by varying the tuning capacitor providing in some cases a perfect 50 ohm match and a resultant 1:1 SWR level. Operational tests indicate excellent performance, especially at the higher range of operation where the high gain and low radiation angle are prevalent.

Figure 18:
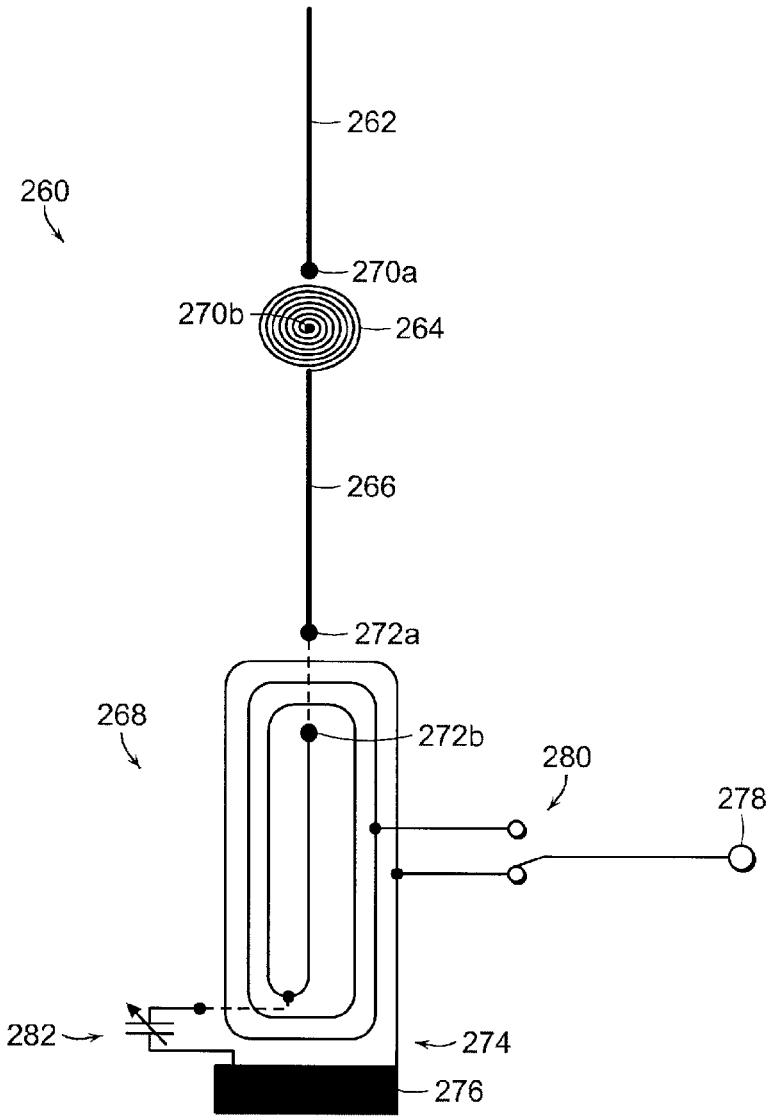
FIG. 18 shows an illustrative diagrammatic view of a frequency adjustable distributed load monopole antenna in accordance with a further embodiment of the invention.

FIG. 18 shows at 260 a plano-spiral distributed load monopole antenna in accordance with a further embodiment of the invention. The antenna 260 includes a top section 262, a current enhancing unit 264, a mid-section 266 and a radiation resistance unit 268 that includes a plurality of windings that are substantially parallel with an elongated central axis of the monopole antenna. The antenna may be formed as a printed circuit, and points 270*a* and 270*b* may be coupled together by a jumper or through a connector path in the circuit board, and points 272*a* and 272*b* may also be coupled together by a jumper or through a connector path within the circuit board. The base 274 of the radiation resistance unit 268 is connected to ground 276, and an input signal may be provided at a port 278 that is selectively connectable to either a fixed point on a loop or is selectively connectable to any of a plurality of loops of the radiation resistance unit 268 via one or more switches as shown at 280.

The printed wiring in such a circuit board fabrication has an upper frequency limit of a few hundred MHz using standard FR4 material for the printed circuit. Higher frequency fabrication is possible using Teflon impregnated substrate material but the physical size of the antenna and conductors becomes limited. In this case, thin film processing on Alumina, Quartz and other materials may be used. This may extend the operating frequency and practical implementation of the antennas to several GHz and beyond.

The antenna 260 of FIG. 18 also includes a capacitor circuit (such as variable capacitor 282) that is coupled to one of the loops (e.g., the last turn) of the radiation resistance unit 268 and ground 276. Frequency tuning of the antennas, for example, may be implemented by placing the variable capacitor 282 (using a jumper or a connector path within the board) onto the last turn of the helix as shown in FIG. 18. An electrical analogy of this is placing a grounded conductor on the substrate beneath or above this last helix turn. The size and width as well as the distance in spacing from the last turn of the helix will change the resonant frequency of the antenna and therefore the frequency of operation of the antenna system.

Again, the variable capacitor used in various embodiments of the invention as disclosed herein may be mechanically controlled (such as a rotary variable capacitor, a sleeve and plunger vacuum variable capacitor, or a slider variable capacitor), electronically controlled (such as variable capacitance diodes for low signal amplitudes) or digitally tunable (such as the DuNE™ digitally tunable capacitor product sold by Peregrine Semiconductor Corporation of San Diego, Calif.).

An electrical equivalent of the antenna of FIG. 18 may be considered (for explanatory purposes) as including a mid-section capacitance at the mid-section and a top-section capacitance at the top section. Such an equivalent circuit includes two low pass filters in series (one including the lower helix and the other including the load coil). In a normal DLM antenna, fabricated in either two or three dimensional geometry, the frequency of operation is determined not only by the size of the helix, load coil and mid section but is greatly affected by the length of the top section. Varying the top section of a DLM will greatly alter antenna resonance and the overall operating frequency. In many cases this is difficult to achieve and impractical for large frequency ranges of operation as well as implementation in other forms of circuits. The antenna circuit is equivalent to two low pass filters connected in series that radiate due to the physical size of the individual components and due to the fact that a current is flowing throughout the combined elements.

Figure 19:
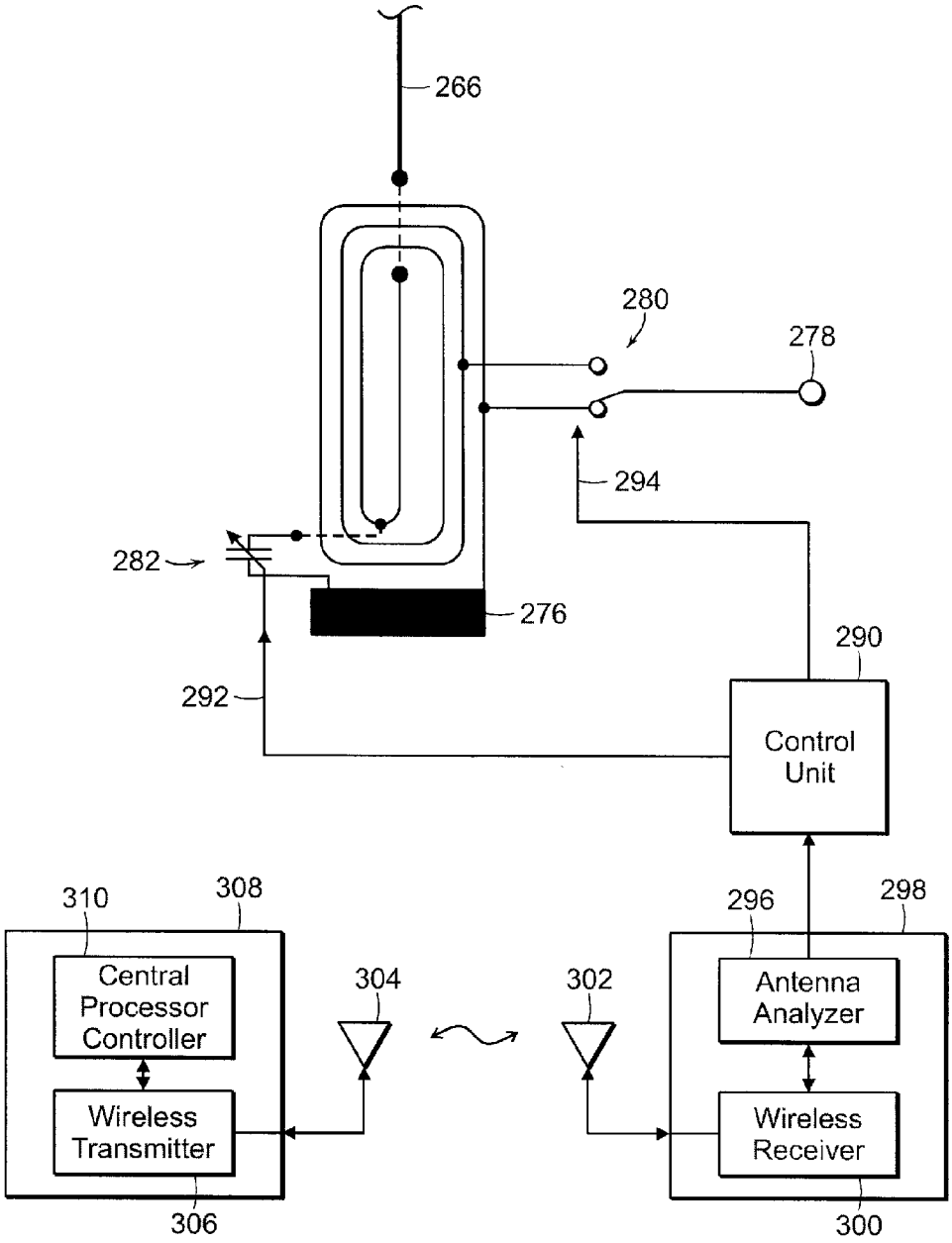
FIG. 19 shows an illustrative diagrammatic view of a frequency adjustable distributed load monopole antenna in accordance with a further embodiment of the invention that includes a wireless control system.

FIG. 19 shows the antenna system 260 of FIG. 18 coupled to an antenna control system that is in turn, coupled to a wireless receiver. Similar to the embodiment discussed above with reference to FIG. 9, the system of FIG. 19 further includes a control unit 290 for providing a variable capacitor control signal 292 to the variable capacitor 282, and for providing a switch control signal 294 for controlling the one or more switches as shown at 280. The control unit 290 receives its instructions from an antenna analyzer 296 of a remote control device 298, and the antenna analyzer 296 receives its command signals from a wireless receiver 300. The wireless receiver 300 is coupled to an antenna 302 and receives signals from an antenna 304 that is coupled to a transmitter 306 of a central control device 308. The transmitter 306 is also coupled to a central processor controller 310. The antenna analyzer 296 may be, for example, an AIM430 Antenna Analyzer Interface product as sold by W5BIG of Richardson, Tex.

The central processor controller 310 generates the command instructions for the control of the variable capacitor 282 and the feed points on the windings (switches 280). These instructions are sent via the transmitter 306 to the receiver 300 of the remote control device 298, and the control unit 290 causes the variable capacitor and the switches to be adjusted in accordance with the instructions as determined to be necessary by the antenna analyzer 296.

Figure 20:
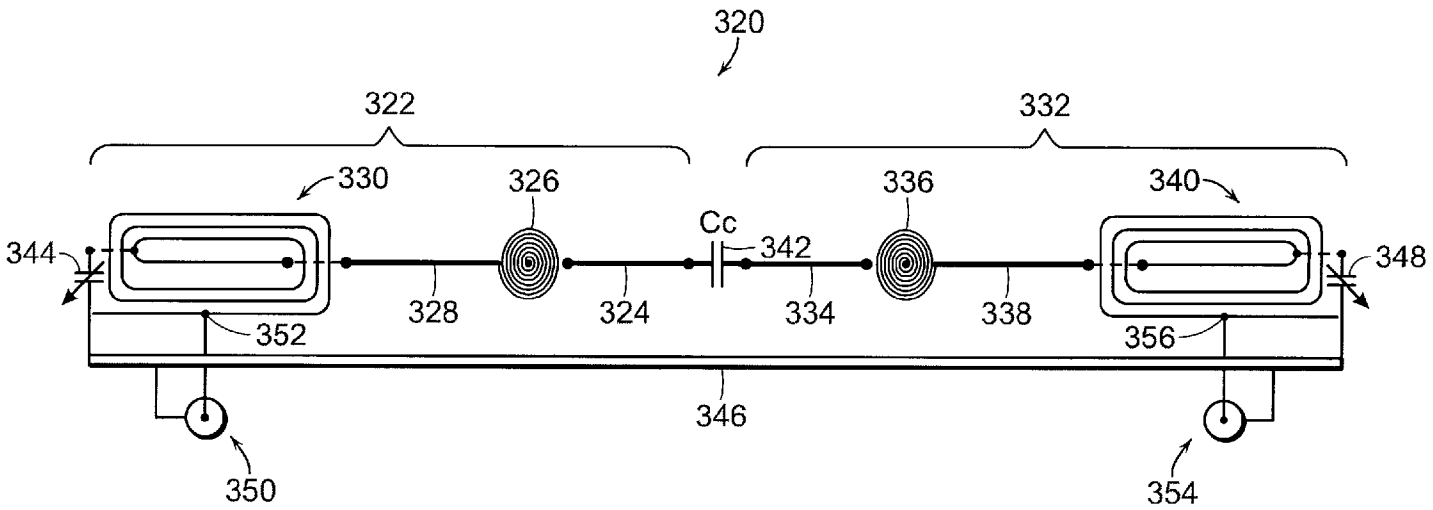
FIG. 20 shows an illustrative diagrammatic view of a pair of frequency adjustable distributed load monopole antennas in a band-pass filter implementation in accordance with a further embodiment of the invention.

The ability to tune dynamically tune such a distributed load monopole antenna, also provides that the antenna may serve as part of a band-pass filter circuit as mentioned above. FIG. 20 shows a distributed load monopole antenna system 320 in which pair of distributed load monopole antennas are implemented together as a band-pass filter. In particular, a first antenna 322 includes a first top section 324, first a current enhancing unit 326, a first mid-section 328 and a first radiation resistance unit 330. A second antenna 332 includes a second top section 334, second a current enhancing unit 336, a second mid-section 338 and a second radiation resistance unit 340.

The antennas 322, 332 are coupled together at their top sections 324,334 by a coupling capacitor 342 as shown. The radiation resistance unit 330 includes a first capacitor circuit (e.g., a first variable capacitor 344) that is coupled (using a jumper or a connector path through the board) at one end to one of the loops of the helix of the first radiation resistance unit 330, and is coupled at the other end of the capacitor 344 to ground 346 as shown. The radiation resistance unit 340 includes a second capacitor circuit (e.g., a second variable capacitor 348) that is coupled (using a jumper or a connector path through the board) at one end to one of the loops of the helix of the second radiation resistance unit 340, and is coupled at the other end of the capacitor 348 to ground 346 as shown. An input port 350 is provided at a first coaxial connector wherein the outer conductor is coupled to ground and the inner conductor is coupled to a feed point 352 on one of the loops of the helix of the first radiation resistance unit 330. An output port 354 is provided at a second coaxial connector wherein the outer conductor is coupled to ground and the inner conductor is coupled to a feed point 356 on one of the loops of the helix of the second radiation resistance unit 340. In accordance with further embodiments, the feed points 352 and 356 may be provided via a network of switches as discussed above, and the network of switches may be coupled to a control unit as discussed above with reference to the above disclosed embodiments. The capacitance of the variable capacitors may also be controlled by a control unit as discussed above with reference to the above disclosed embodiments.

The antenna system 320 provides a band-pass filter wherein an input signal is provided to the coaxial input port 350 and an output signal is provided at the coaxial output port 354. Only signals that match the band-pass frequency of each antenna 322 and 332 will be provided from the input port 350 to the output port 354. An electrically equivalent circuit may be considered as one that includes an input coupled to a feed-point on a turn of a first inductor that is coupled to a first capacitor in parallel with the first inductor, and an output coupled to a feed-point on a turn of a second inductor that is coupled to a second capacitor in parallel with the second inductor, wherein the non-grounded ends of the first and second capacitors are coupled together via a coupling capacitor. Each side of the circuit provides a band-pass filter, and then both are tuned to the same pass band, and a band-pass filter implementation is thereby provided between the input and output ports.

Figure 21:
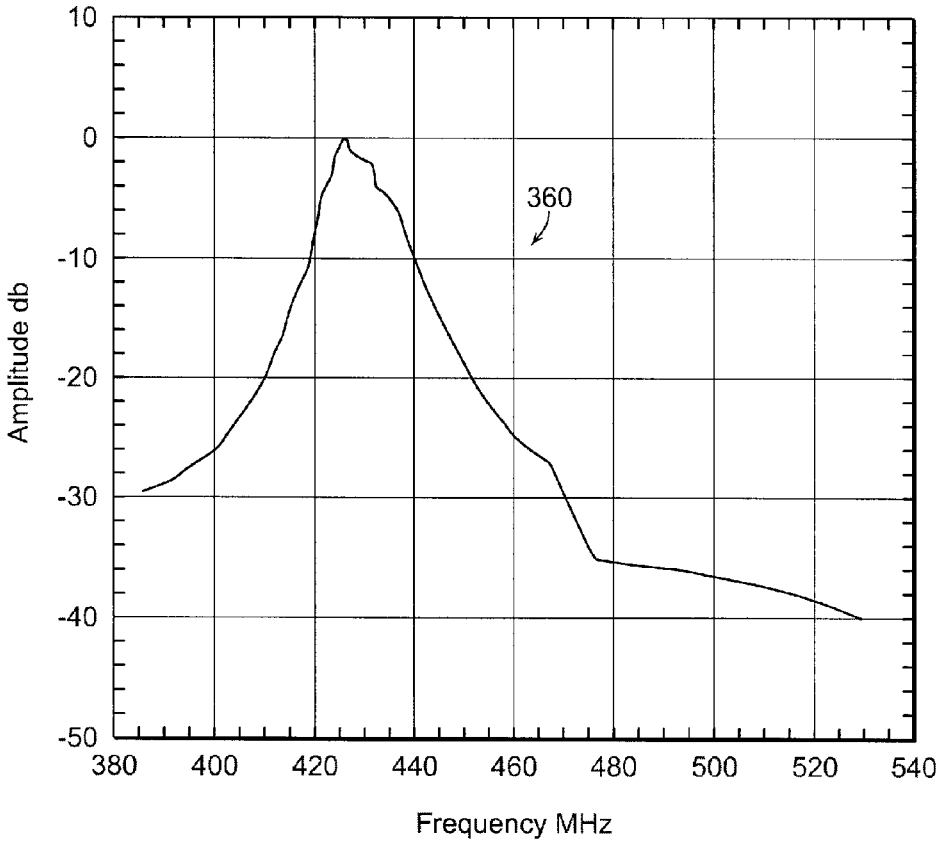
FIG. 21 shows an illustrative graphical view of frequency verses amplitude in a distributed load monopole antenna in accordance with an embodiment of the invention.

FIG. 21 shows at 360 a plot of frequency verses amplitude of a band-pass filter implementation of a distributed load monopole antenna system of FIG. 20 fabricated on a FR-4 printed circuit board material at 426 MHz. The pass-band may be defined around 426 MHz through amplitude filtering, optionally followed by amplification to provide a band-pass filtered signal.

Figure 22:
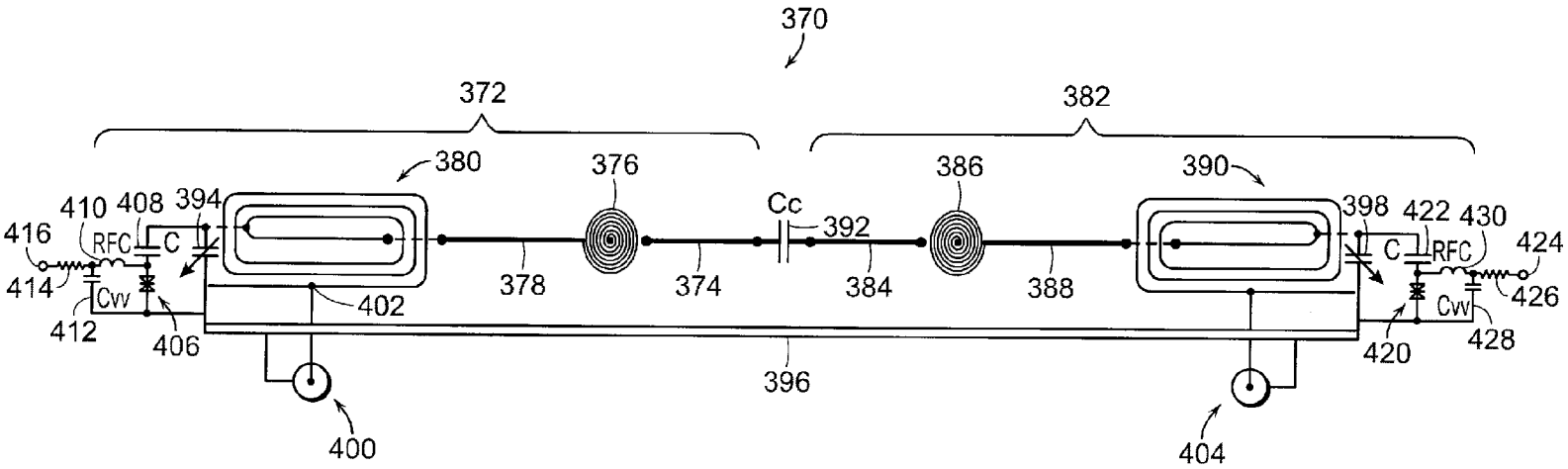
FIG. 22 shows an illustrative diagrammatic view of a pair of frequency adjustable distributed load monopole antennas in a voltage controlled variable frequency band-pass filter implementation in accordance with a further embodiment of the invention that further includes voltage variable capacitance diodes.

FIG. 22 shows a distributed load monopole antenna system 370 in which pair of distributed load monopole antennas are also implemented together as a band-pass filter. Similar to the embodiment of FIG. 21, a first antenna 372 includes a first top section 374, first a current enhancing unit 376, a first mid-section 378 and a first radiation resistance unit 380. A second antenna 382 includes a second top section 384, second a current enhancing unit 386, a second mid-section 388 and a second radiation resistance unit 390. The antennas 372, 382 are coupled together at their top sections 374, 384 by a coupling capacitor 392 as shown. The radiation resistance unit 380 includes a first capacitor circuit (including a first variable capacitor 394) that is coupled (using a jumper or a connector a path through the board) at one end to one of the loops of the helix of the first radiation resistance unit 380, and is coupled at the other end of the capacitor 394 to ground 396 as shown. The radiation resistance unit 390 includes a second capacitor circuit (e.g., a second variable capacitor 398) that is coupled (using a jumper or a connector path through the board) at one end to one of the loops of the helix of the second radiation resistance unit 390, and is coupled at the other end of the capacitor 398 to ground 396 as shown.

An input port 400 is provided at a first coaxial connector wherein the outer conductor is coupled to ground and the inner conductor is coupled to a feed point 402 on one of the loops of the helix of the first radiation resistance unit 380. An output port 404 is provided at a second coaxial connector wherein the outer conductor is coupled to ground and the inner conductor is coupled to a feed point 418 on one of the loops of the helix of the second radiation resistance unit 390. In accordance with further embodiments, the feed points 402 and 418 may be provided via a network of switches as discussed above, and the network of switches may be coupled to a control unit as discussed above with reference to the above disclosed embodiments. The capacitance of the variable capacitors may also be controlled by a control unit as discussed above with reference to the above disclosed embodiments.

The first capacitance circuit of the antenna 372 also includes a voltage variable capacitance diode 406 coupled to a DC blocking capacitor 408. A voltage input is provided at 416 to the voltage variable capacitance diode 406 through a resistor 414 via a decoupling capacitor 412 and through an RF choke 410. The second capacitance circuit of the antenna 390 also includes a voltage variable capacitance diode 420 coupled to a DC blocking capacitor 422. A voltage input is provided at 424 to a voltage variable capacitance diode 420 through a resistor 426 via a decoupling capacitor 428 and through an RF choke 430.

The tuning of the individual antenna elements in FIG. 22 is performed by the variable capacitance diodes 406 and 420. The devices are essentially semiconductor diodes that change in capacitance when an applied DC voltage applied is varied. Each capacitor 408 and 422 is many times larger that the capacitor range of the voltage variable capacitance diodes 406 and 420. The sole purpose of the capacitors 408 and 422 is to block the DC voltage applied across one diode from the circuit to which the capacitance is applied, which is the antenna element. The DC voltage is applied from a fixed or variable supply thru the resistor 414, 422 which is RF decoupled by the RF choke 410, 430 and the decoupling capacitor 412, 428. This isolates the variable capacitance diode from the DC supply voltage by the high RF impedance provided by the RF choke. The decoupling capacitor 412, 428 and resistor 414, 426 also prevent noise from the power supply varying the capacitance of the diode by filtering it. The circuit functions in a way that as far as the antenna element is concerned it sees a capacitance that is no different than placing a physical capacitor in place of the entire tuning circuit.

The antenna system 370 provides a band-pass filter wherein an input signal is provided to the coaxial input port 400 and an output signal is provided at the coaxial output port 404. Only signals that match the band-pass frequency of each antenna 372 and 382 will be provided from the input port 400 to the output port 404. An electrically equivalent circuit may be considered as one that includes an input coupled to a feed-point on a turn of a first inductor that is coupled to a first capacitor in parallel with the first inductor, and an output coupled to a feed-point on a turn of a second inductor that is coupled to a second capacitor in parallel with the second inductor, wherein the non-grounded ends of the first and second capacitors are coupled together via a coupling capacitor. Each side of the circuit provides a band-pass filter, and then both are tuned to the same pass band, and a band-pass filter implementation is thereby provided between the input and output ports.

The circuit of FIG. 22 therefore, provides a voltage variable band-pass filter. Many further types of circuits and systems may be provided that employ distributed load monopole antennas in accordance with many further embodiments of the invention because the distributed load monopole antenna is a resonant tuned circuit and the Q of this circuit may be adjusted by varying the coupling capacitor Cc. Over coupling will produce various bandwidths for wideband applications. The tuning voltage is not limited to a fixed voltage and a variable voltage such as saw-tooth may be used in certain embodiments to implement variable frequency sweeping filters. These are but just a few applications and many number of circuits and systems possible.

In accordance with certain embodiments, the second distributed load monopole antenna may be fabricated on the opposite side of the printed wiring board containing the first distributed load monopole antenna; this may eliminate the need for a coupling capacitor if the circuit board itself is formed of the an appropriate dielectric material. Such a design, however, may result in over-coupling and interaction of tuning in certain applications. A better method for some applications may be to fabricate the second antenna on separate circuit board, and then mount the second half of the filter spaced a certain distance from the first circuit board including the first antenna. The filter coupling will then depend on this distance.

Figure 23:
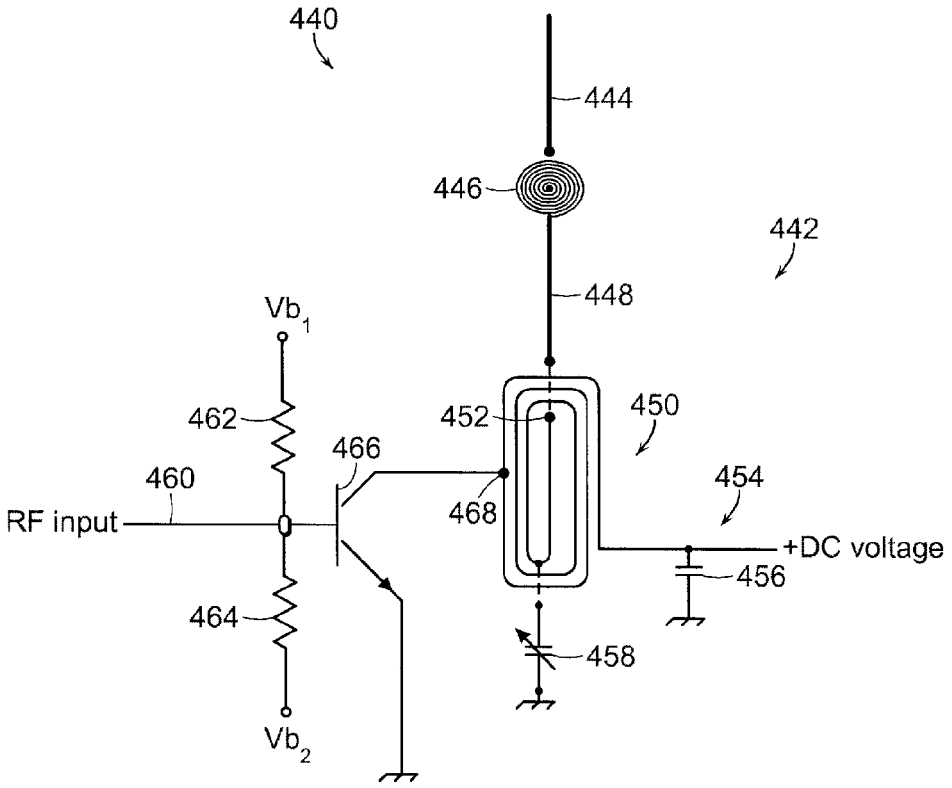
FIG. 23 shows an illustrative diagrammatic view of an antenna system in accordance with a further embodiment of the invention that integrally provides an amplifier functionality.

In accordance with further embodiments, distributed load monopole antenna systems may integrally provide an amplifier functionality together with the antenna. FIG. 23 shows a system 440 that includes a distributed load monopole antenna 442 including a top section 444, a current enhancing unit 446, a mid-section 448 and a radiation resistance unit 450. The radiation resistance unit 450 includes a plano-spiral helix that is wound such that it includes a plurality of windings that include elongated portions that are substantially parallel with the elongated axis of the antenna. One end 452 of the plano-spiral helix is coupled to the mid-section (via a jumper) as discussed above, and the other end 454 is connected to a +DC amplifier voltage and a capacitor 456 that is also coupled to ground. A capacitor circuit including a variable capacitor 458 is coupled to one of the loops of the helix of the radiation resistance unit 450 using a jumper or a connector path through the board as shown, and in further embodiments, a switching network as discussed above may also be employed for switching the connection point of the variable capacitor to the helix to provide further adjustability of the operating resonant frequency.

The amplifier network receives an RF input signal 460 between resistors 462 and 464 of an amplifier bias network (for example, where $b_1$ is $V_{cc}$ and $b_2$ is ground), and provides the RF input signal to a base of a transistor 466. The emitter of the transistor is coupled to ground, while the collector is coupled to a feed point on one of the loops of the helix of the radiation resistance unit 450. In further embodiments, a switching network as discussed above may also be employed for switching the connection point of the amplifier network to the helix (at the collector of the transistor 466 of the amplifier network) to provide further adjustability of the operating resonant frequency.

When designing a circuit to drive an antenna such as an implementation of a cellular phone output circuit for transmitting radio frequency information, or for any type of low power radio frequency transmitter or transceiver, the RF amplifier must have a tuned circuit (or some form of circuit or circuit system) to provide a matching impedance to the antenna so that maximum power may be transferred from the amplifier to the antenna. This usually results in additional circuitry and additional space in the overall circuit. The amplifier-antenna embodiment of the system of FIG. 23, therefore, includes a combined amplifier matching, antenna and associated additional circuitry in one circuit.

Figure 24:
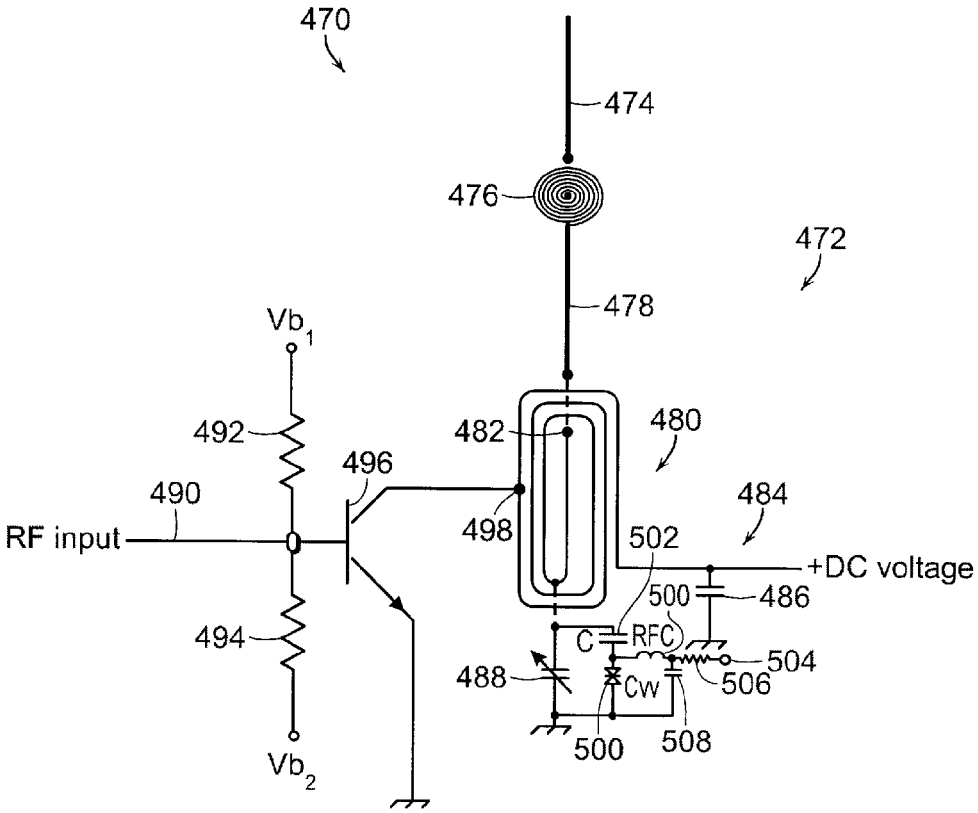
FIG. 24 shows an illustrative diagrammatic view of an antenna system in accordance with a further embodiment of the invention that integrally provides an amplifier functionality and includes a voltage variable capacitance diode.

FIG. 24 shows an implementation of an antenna system 470 that also includes a distributed load monopole antenna 472 including a top section 474, a current enhancing unit 476, a mid-section 478 and a radiation resistance unit 480. The radiation resistance unit 480 includes a plano-spiral helix that is wound such that it includes a plurality of windings that include elongated portions that are substantially parallel with the elongated axis of the antenna. One end 482 of the plano-spiral helix is coupled to the mid-section (via a jumper) as discussed above, and the other end 484 is connected to a +DC amplifier voltage and a capacitor 486 that is also coupled to ground. A capacitor circuit including a variable or fixed capacitor 488 is coupled to one of the loops of the helix of the radiation resistance unit 490 using a jumper or a connector path through the board as shown, and in further embodiments, a switching network as discussed above may also be employed for switching the connection point of the variable capacitor to the helix to provide further adjustability of the operating resonant frequency.

The capacitor circuit of the antenna system 470 also includes a voltage variable capacitance diode 500 coupled to a DC blocking capacitor 502. A voltage input is provided at 504 to the voltage variable capacitance diode 500 through a resistor 506 via a decoupling capacitor 508 and through an RF choke 510. The tuning of the antenna system in FIG. 24 is performed by the variable capacitance diode 500. Again, such a device is essentially a semiconductor diode that changes in capacitance when an applied DC voltage is varied. The capacitor 502 is many times larger that the capacitor range of the voltage variable capacitance diode 500, and the sole purpose of the capacitor 502 is to block the DC voltage applied across one diode from the circuit to which the capacitance is applied, which is the antenna element. The DC voltage is applied from a fixed or variable supply through the resistor 506, which is RF decoupled by the RF choke 510 and the decoupling capacitor 508. This isolates the variable capacitance diode from the DC supply voltage by the high RF impedance provided by the RF choke. The decoupling capacitor 508 and resistor 506 also prevent noise from the power supply varying the capacitance of the diode by filtering it. The circuit functions in a way that as far as the antenna element is concerned it sees a capacitance that is no different than placing a physical capacitor in place of the entire tuning circuit.

The amplifier network receives an RF input signal 490 between resistors 492 and 494 of an amplifier bias network (for example, where $b_1$ is $V_{cc}$, and $b_2$ is ground), and provides the RF input signal to a base of a transistor 496. The emitter of the transistor is coupled to ground, while the collector is coupled to a feed point on one of the loops of the helix of the radiation resistance unit 480. In further embodiments, a switching network as discussed above may also be employed for switching the connection point of the amplifier network to the helix (at the collector of the transistor 496 of the amplifier network) to provide further adjustability of the operating resonant frequency.

In further embodiments, the DC voltage 484 may be varied to provide remote tuning. This could further be used together with an amplifier/radiator to tune and thereby compensate for environmental changes in the area of the antenna. This may be useful, for example, to compensate for the user capacitance in hand held transceivers or cellular phones.

Figure 25:
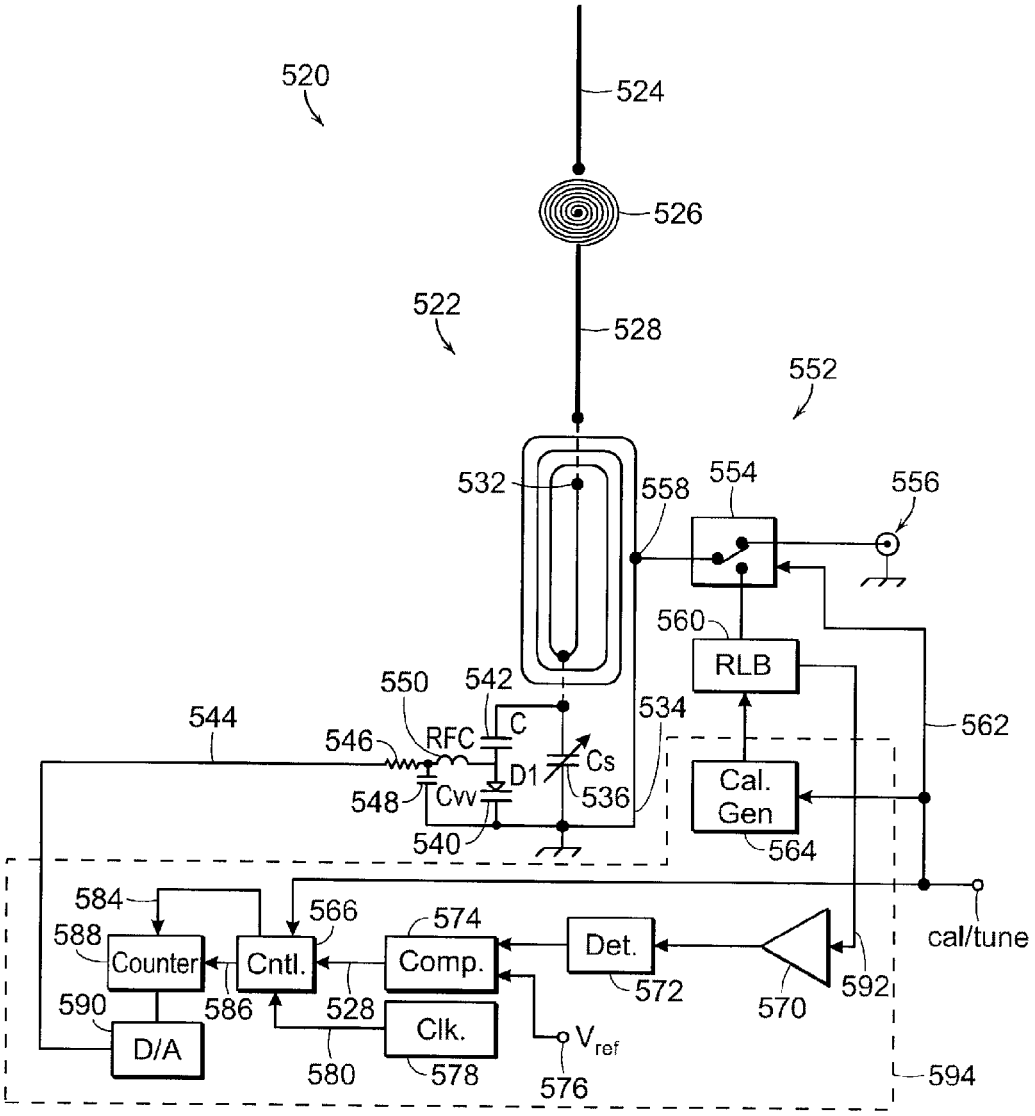
FIG. 25 shows an illustrative diagrammatic view of an antenna system in accordance with a further embodiment of the invention that provides an environmentally adaptive antenna.

In accordance with further embodiments, it may be desired to change the operating characteristics of an antenna during use where, for example, environmental conditions affect the operating frequency of the antenna. FIG. 25 shows an example of an antenna system for use in an environmentally adaptive antenna system in accordance with a further embodiment of the invention. In particular, in situations where an antenna may become detuned due to local objects or handling by a device user, the antenna may be automatically retuned for maximum performance. FIG. 25 shows an adaptive antenna system 520 that includes a distributed load monopole antenna 522 that includes a top section 524, a current enhancing unit 526, a mid-section 528 and a radiation resistance unit 530. The radiation resistance unit 530 includes a plano-spiral helix that is wound such that it includes a plurality of windings that include elongated portions that are substantially parallel with the elongated axis of the antenna. One end 532 of the plano-spiral helix is coupled to the mid-section (via a jumper) as discussed above, and the other end 534 is connected to ground. A capacitor circuit including variable or fixed capacitor 536 is coupled to one of the loops of the helix of the radiation resistance unit 530 using a jumper or a connector path through the board as shown, and in further embodiments, a switching network as discussed above may also be employed for switching the connection point of the variable capacitor to the helix to provide further adjustability of the operating resonant frequency.

The capacitor circuit of the antenna system 520 also includes a voltage variable capacitance diode 540 coupled to a DC blocking capacitor 542. A control voltage input signal is provided at 544 to the voltage variable capacitance diode 540 through a resistor 546 via a decoupling capacitor 548 and through an RF choke 550. The tuning of the antenna system in FIG. 26 is performed by the variable capacitance diode 540. Such a device is essentially a semiconductor diode that changes in capacitance when an applied DC voltage is varied. The capacitor 542 is many times larger that the capacitor range of the voltage variable capacitance diode 540, and the sole purpose of the capacitor 542 is to block the DC voltage applied across one diode from the circuit to which the capacitance is applied, which is the antenna element. The DC voltage 544 is applied from a fixed or variable supply through the resistor 546, which is RF decoupled by the RF choke 550 and the decoupling capacitor 548. This isolates the variable capacitance diode from the DC supply voltage by the high RF impedance provided by the RF choke. The decoupling capacitor 548 and resistor 546 also prevent noise from the power supply varying the capacitance of the diode by filtering it. The circuit functions in a way that as far as the antenna element is concerned, it sees a capacitance that is no different than placing a physical capacitor in place of the entire tuning circuit.

The antenna also includes a feed-point switch network 552 for remotely tuning the antenna as described above with reference to the embodiments show in FIGS. 7, 9, 10 and 13. Additionally, a switch 554 may be employed in the feed-point switch network to switch between coupling an RF input/output port 556 to the antenna at a feed-point 558, or for coupling a return loss bridge 560 to the feed-point 558 responsive to a calibration oscillator signal 562. The calibration oscillator signal 562 also controls a calibration generator unit 564 as shown, which in turn controls the return loss bridge 560. At the base of the antenna is the capacitance 536 (Cs), which is a frequency of resonance set capacitor and sets the antenna to initial frequency of operation. Depending on the characteristics of the tuning diode (D1) the capacitor 536 (Cs) is set for the minimum or maximum frequency range of the antenna. Capacitor 542 (C) is very large, e.g., many times more capacity than the voltage variable capacitance diode 540 (D1). A voltage is applied to D1 through the radio frequency choke 550 (RFC) and an RC network. The RF choke isolates the capacitance diode and it's capacitance from the tuning voltage and RC network filters this voltage. The RC network prevents radio frequency energy from getting back to the source of tuning voltage and also decouples noise from the tuning voltage circuit causing antenna tuning variations.

The calibration oscillator signal 562 is also provided to a control logic circuit 566 of a feedback circuit 568. The feedback circuit 568 includes an amplifier 570 that is coupled to the return loss bridge 560. The output of the amplifier 570 is coupled to a detector 572, which in turn is coupled to a comparator 574. The comparator 574 also receives an input voltage at a reference frequency 576. A clock signal 580 is provided by clock oscillator 582, and this clock signal 580 as well as an output 582 of the phase comparator 574 and the calibration/tune signal 562 are all provided to a control logic circuit 566. The control logic circuit 566 provides a counter control signal 584, as well as a input voltage signal 586 to a counter 588. The counter 588 provides an incrementing voltage control signal to the digital-to-analog converter 590 that increments with each clock count. The output of the digital-to-analog converter 590 is provides the control voltage input signal 544 for the antenna tuning circuit.

At the onset of a tuning command to calibrate or tune the antenna, the input switch 554 is switches the input to the antenna from 556 to the calibration oscillator signal 562. The calibration oscillator signal is provided to the input to the antenna via the calibration generator unit 654 and the return loss bridge 560 that measures the return loss of the antenna system. The calibration oscillator signal is also provided to the control logic unit 566, which causes a counter signal to begin incrementing.

A maximum return loss results in zero volts output from the return loss bridge (RTLB) indicates that the antenna has been tuned for maximum performance and minimum Standing Wave Ratio (SWR). This output of the RTLB (as shown at 592) is amplified by amplifier 570 and converted to a DC voltage by the detector 572. There is filtering within the detector circuit that results in a clean DC voltage free of radio frequency ripple components but the signal does have some DC offset programmed within the detector. The comparator 574 is looking for a voltage that will indicate favorable comparison with the reference voltage 576. Thus, with minimum return loss, the detector offset voltage and the reference will be nearly equal. This will result in the counter 588 to stop incrementing and the voltage decoded by the D/A converter 590 will be present at the D/A output, which is the control voltage input signal 544. This voltage causes the antenna to be tuned for optimum performance as detected by the RTLB circuitry and the detector. This will be within a specified limit of the comparator causing the logic to stop incrementing the counter as discussed above, but will also provide an optimal voltage that tunes the antenna to maximum performance for the operating frequency as specified by the frequency of the calibrating generator.

Due to the use of a digital counter, a perfect return loss may not be obtainable and the closest favorable return loss will be identified. The comparator therefore, will have a switching limit that will be within a favorable limit of operation of the antenna (typically this is a return loss of 9 to 10 db and corresponds to a SWR of 2:1). Any return loss of greater that 10 db will result in the best operating condition of the antenna and the lowest SWR. The switch 544 then returns the antenna feed-point 558 to be coupled to the RF input/output port 556.

The antenna may be periodically checked for operation by initiating another calibrate command or additional circuitry can be added that will automatically retune the antenna for varying environmental changes within the antenna operating environment. Though the above system includes discrete components in the above-discussed embodiment, it becomes readily apparent that a microprocessor properly programmed may perform all the functions of the circuit with the exception of the return loss bridge and the antenna tuning components. The calibration generator 564, amplifier 570, detector 572, comparator 574, clock 570, control logic 566, counter controller 584, counter unit 588 and D/A converter 590 may be provided in a microprocessor as shown at 594 in accordance with an embodiment wherein the microprocessor is programmed to provide the above discussed functionality. A very compact circuit with all of the above control functionality may therefore be implemented at a much reduced cost.

In accordance with further embodiments, a distributed load monopole antenna may be used in an antenna system that provides a very accurate oscillator with a frequency compensating control voltage. Local oscillators for example, are employed in many applications, and are typically required to be very accurate. Local oscillators may be used for example in certain wireless telephone communication systems to down-convert radio frequency signal to baseband signals and to up-convert baseband signals to radio frequency signals. In such systems, it may be very important to provide a non-varying local oscillator signal. See for example, U.S. Pat. No. 7,099,643.

FIG. 26 shows an antenna system in accordance with a further embodiment of the invention, wherein a tunable antenna provides a frequency determining circuit in a voltage controlled oscillator/radiator. The system 600 includes a distributed load monopole antenna 602 that includes a top section 604, a current enhancing unit 606, a mid-section 608 and a radiation resistance unit 610. The radiation resistance unit 610 includes a plano-spiral helix that is wound such that it includes a plurality of windings that include elongated portions that are substantially parallel with the elongated axis of the antenna. One end 612 of the plano-spiral helix is coupled to the mid-section (via a jumper) as discussed above, and the other end 614 is connected to ground. A capacitor circuit including variable or fixed capacitor 616 is coupled to one of the loops of the helix of the radiation resistance unit 610 using a jumper or a connector path through the board as shown, and in further embodiments, a switching network as discussed above may also be employed for switching the connection point of the variable capacitor to the helix to provide further adjustability of the operating resonant frequency.

The capacitor circuit of the antenna system 600 also includes a voltage variable capacitance diode 620 coupled to a DC blocking capacitor 622. A control voltage input signal is provided at 624 to the voltage variable capacitance diode 620 through a resistor 626 via a decoupling capacitor 628 and through an RF choke 630. The tuning of the antenna system in FIG. 26 is performed by the variable capacitance diode 620. Again, such a device is essentially a semiconductor diode that changes in capacitance when an applied DC voltage is varied. The capacitor 622 is many times larger that the capacitor range of the voltage variable capacitance diode 620, and the sole purpose of the capacitor 622 is to block the DC voltage applied across one diode from the circuit to which the capacitance is applied, which is the antenna element. The DC voltage is applied from a fixed or variable supply through the resistor 626, which is RF decoupled by the RF choke 630 and the decoupling capacitor 628. This isolates the variable capacitance diode from the DC supply voltage by the high RF impedance provided by the RF choke. The decoupling capacitor 628 and resistor 626 also prevent noise from the power supply varying the capacitance of the diode by filtering it. The circuit functions in a way that as far as the antenna element is concerned it sees a capacitance that is no different than placing a physical capacitor in place of the entire tuning circuit.

The amplifier receives an RF signal 634 through a capacitor 648 between resistors 636 and 638 of an amplifier bias network (for example, where $b_1$ is an oscillator supply voltage 640 ($V_{cc}$) and $b_2$ is ground), and provides via a feed point from one of the loops of the helix of the radiation resistance unit 630, the RF signal to a base of a transistor 632. The emitter of the transistor 632 is coupled to ground, while the collector is coupled to an oscillator supply voltage 640 via an inductor 642 and a capacitor 644 that is also coupled to ground. An output oscillator signal 656 is provided from the collector of the transistor 632 via an amplifier 658. In further embodiments, a switching network as discussed above may also be employed for switching the connection point of the amplifier network to the helix (at the base of the transistor 632 of the amplifier bias network) to provide further adjustability of the operating resonant frequency.

The system 600 also includes a frequency divider 646 that receives the output signal 656 at an output port 660. The output of the frequency divider 646 is provided to a phase comparator 650 that also receives an input from a reference voltage 652 as shown. The output of the phase comparator 650 is provided as the control voltage input 624 to the voltage variable capacitance diode 620 through the resistor 626, decoupling capacitor 628 and RF choke 630. A feedback circuit (that may include one or more amplifiers) is also provided as shown at 654 from the mid-section 608 of the antenna 602 to the signal 648.

The antenna system of FIG. 26 may be tuned to provide a frequency determining circuit in a voltage controlled oscillator/radiator. In particular, the frequency tuning elements are as discussed above with reference to FIGS. 22 and 24, with the capacitor 616 (Cs) providing an oscillator set frequency. This setting may be either at a high or low end of an oscillator frequency range, with incremental adjustments either increasing or decreasing to cover a portion of the adjustment range depending on the capacity variations vs. voltage of the tuning diode D1. The RF choke 630, the capacitor 628 (Cvv) and the resistor 626 (R) function to isolate the tuning voltage from the antenna and to prevent tuning voltage noise from changing the tuning of the antenna.

During use, the output of the oscillator transistor 632 is coupled to the amplifier 658 and this amplifier along with the amplifier 654 combine to provide feedback to the transistor 632 in such a phase as to cause the transistor 632 to become unstable and oscillate at a frequency determined by the characteristic of the antenna, (it's natural resonant frequency) as set by the values of Cs and D1.

In particular, the output of amplifier 658 drives a frequency divider and this frequency divider provides that the division of the oscillator frequency equals the frequency of the reference voltage signal 652 ($V_{ref}$). The phase comparator 650 produces a DC output voltage that is a function of the phase difference between the divided oscillator frequency and the frequency of the reference voltage signal 652.

For example, if the oscillator frequency was 1000 MHz and the frequency divider division was a factor of 1000, then its output would be 1 MHz. and the phase comparator output voltage would be such that it would keep the oscillator frequency at 1000 MHz or within the tolerance of the phase comparator output voltage. Thus in this case the 1000 MHz oscillator frequency is phase locked to the 1 MHz reference. The 1 MHz reference is of high stability and the oscillator would be phase locked to the stability of the reference oscillator. If the frequency divider were to change such that it divided by 990 then the oscillator frequency would increase to 990 MHz because the phase comparator voltage acting on the capacitor diode 620 (D1) would decrease driving the oscillator frequency down to 990 MHz. This because 990 MHz divided by 990 is 1 MHz and the circuit wants to be phase locked to the 1 MHz reference. Like wise if the divider was to divide by 1010 then the oscillator frequency would increase to 1010 MHz. This is because dividing 1010 MHz of the oscillator frequency by 1010 is 1 MHz and again, the system wants to lock to the 1 MHz reference.

The relationship is such that the frequency of the oscillator signal ($f_{oscillator}$) is equal to N times the frequency of the reference signal ($f_{reference}$). If N=990, and $f_{reference}$=1 MHz, then $f_{oscillator}$ must be 990 MHz phase locked to $f_{referencer}$.

It readily becomes apparent that such systems may provide oscillators of very high stability. One skilled in the art of frequency synthesis will recognize the benefits of this system and a direct radiating oscillator, incremented by N times $f_{reference}$ and phase locked to $f_{reference}$. If the transistor 632 is a power oscillator transistor, then the function of an oscillator, a power amplifier, an antenna and a phase locked system is combined in one circuit element.

Those skilled in the art will appreciate that numerous modifications and variations may be made to the above disclosed embodiments without departing from the spirit and scope of the invention.

What is claimed is:

1. A distributed load monopole antenna system including a monopole antenna comprising:

a radiation resistance unit coupled to a transmitter base, said radiation resistance unit including a radiation resistance unit base that is coupled to ground, and including a plurality of windings of an electrically conductive material;

a capacitor circuit including a variable capacitor, said capacitor circuit having first and second connection leads, wherein said first connection lead is coupled to one of the plurality of windings of said radiation resistance unit, and said second connection lead is coupled to ground;

a current enhancing unit for enhancing current through said radiation resistance unit; and a conductive mid-section intermediate said radiation resistance unit and said current enhancing unit;

wherein said distributed load monopole antenna system includes a return loss bridge and control system for adjusting the capacitor circuit to accommodate changes in an operating environment.

2. The distributed load monopole antenna system as claimed in claim 1, wherein said variable capacitor is coupled to a motor for adjusting a capacitance of the variable capacitor.

3. The distributed load monopole antenna system as claimed in claim 1, wherein said variable capacitor includes a voltage variable capacitance diode.

4. The distributed load monopole antenna system as claimed in claim 1, wherein said control system includes a clock and a counter for providing incremental voltage adjustments to the capacitor circuit.

5. The distributed load monopole antenna system as claimed in claim 1, wherein said distributed load monopole antenna system includes a transistor coupled to the radiation resistance unit and a feedback path from the transistor back to the radiation resistance unit, wherein said feedback path causes the transistor to become unstable.

6. The distributed load monopole antenna system as claimed in claim 5, wherein said feedback path includes a frequency divider and a phase comparator.

7. A method of providing a distributed load monopole antenna system, said method comprising the steps of:

coupling a radiation resistance unit to a transmitter base and to ground, said radiation resistance unit including a plurality of windings of an electrically conductive material;

providing a current enhancing unit for enhancing current through said radiation resistance unit;

providing a conductive mid-section intermediate said radiation resistance unit and said current enhancing unit; and coupling a first connection lead of a capacitor circuit to one of the plurality of windings of said radiation resistance unit, and coupling a second connection lead of the capacitor circuit to ground;

wherein said method further includes the step of varying the capacitance of the capacitor circuit, and wherein said step of varying the capacitance of the capacitor circuit involves varying a control signal to a motor that is coupled to a variable capacitor in the capacitor circuit, wherein said method further includes the step of providing a feedback path from a transistor that is coupled to the radiation resistance unit, and wherein said feedback path includes a phase comparator and causes the transistor to become unstable.

8. The method as claimed in claim 7, wherein said step of varying the capacitance further involves varying a voltage on at least one voltage variable capacitance diode.

9. The method as claimed in claim 7, wherein said step of varying the capacitance provides adjustment of the distributed load monopole antenna to accommodate changes in an operating environment.

10. A distributed load monopole antenna system including a monopole antenna comprising:

a radiation resistance unit coupled to a transmitter base, said radiation resistance unit including a radiation resistance unit base that is coupled to ground, and including a plurality of windings of an electrically conductive material;

a capacitor circuit including a variable capacitor, said capacitor circuit having first and second connection leads, wherein said first connection lead is coupled to one of the plurality of windings of said radiation resistance unit, and said second connection lead is coupled to ground;

a current enhancing unit for enhancing current through said radiation resistance unit; and a conductive mid-section intermediate said radiation resistance unit and said current enhancing unit;

wherein said distributed load monopole antenna system includes a transistor coupled to the radiation resistance unit and a feedback path from the transistor back to the radiation resistance unit, wherein said feedback path causes the transistor to become unstable.

11. The distributed load monopole antenna system as claimed in claim 10, wherein said variable capacitor is coupled to a motor for adjusting a capacitance of the variable capacitor.

12. The distributed load monopole antenna system as claimed in claim 10, wherein said variable capacitor includes a voltage variable capacitance diode.

13. The distributed load monopole antenna system as claimed in claim 10, wherein said distributed load monopole antenna system includes a return loss bridge and control system for adjusting the capacitor circuit to accommodate changes in an operating environment.

14. The distributed load monopole antenna system as claimed in claim 13, wherein said control system includes a clock and a counter for providing incremental voltage adjustments to the capacitor circuit.

15. A method of providing a distributed load monopole antenna system, said method comprising the steps of:

coupling a radiation resistance unit to a transmitter base and to ground, said radiation resistance unit including a plurality of windings of an electrically conductive material;

providing a current enhancing unit for enhancing current through said radiation resistance unit;

providing a conductive mid-section intermediate said radiation resistance unit and said current enhancing unit; and coupling a first connection lead of a capacitor circuit to one of the plurality of windings of said radiation resistance unit, and coupling a second connection lead of the capacitor circuit to ground;

wherein said method further includes the step of providing a feedback path from a transistor that is coupled to the radiation resistance unit back to the radiation resistance unit, wherein said feedback path includes a phase comparator and causes the transistor to become unstable.

16. The method as claimed in claim 15, wherein said method further includes the step of varying the capacitance of the capacitor circuit.

17. The method as claimed in claim 15, wherein said step of varying the capacitance involves varying a control signal to a motor that is coupled to a variable capacitor in the capacitor circuit.

18. The method as claimed in claim 15, wherein said step of varying the capacitance involves varying a voltage on at least one voltage variable capacitance diode.

19. The method as claimed in claim 15, wherein said step of varying the capacitance provides adjustment of the distributed load monopole antenna to accommodate changes in an operating environment.

* * * * *